US005243742A

United States Patent [19]

Nishimura et al.

[11] Patent Number: 5,243,742

[45] Date of Patent: Sep. 14, 1993

[54] WARP SUPPLYING APPARATUS FOR A WARP THREADING MACHINE

[75] Inventors: Yoshihide Nishimura, Ehime; Hiroshi Yamada, Matsuyama, both of Japan

[73] Assignee: Teijin Seiki Co., Ltd., Osaka, Japan

[21] Appl. No.: 963,670

[22] Filed: Oct. 20, 1992

[30] Foreign Application Priority Data

Oct. 25, 1991 [JP] Japan ..... 3-278158
Oct. 25, 1991 [JP] Japan ..... 3-278160
Oct. 28, 1991 [JP] Japan ..... 3-280223

[51] Int. Cl.[5] ..... D03J 1/14

[52] U.S. Cl. ..... 28/202; 28/203.1; 28/208

[58] Field of Search ..... 28/201, 202, 203.1, 28/208, 204, 207, 206, 205, 212, 209, 210, 211, 213

[56] References Cited

U.S. PATENT DOCUMENTS 4,878,279 11/1989 Tachibana et al. ..... 28/203.1
4,894,893 1/1990 Okuda ..... 28/202 X
4,916,784 4/1990 Tachibana et al. ..... 28/203.1
4,989,301 2/1991 Ishii et al. ..... 28/204
5,079,811 1/1992 Tachibana et al. ..... 28/204

FOREIGN PATENT DOCUMENTS 0391612 10/1990 European Pat. Off. ..... 28/204
63-315647 12/1988 Japan .
2307943 12/1990 Japan ..... 28/204

*Primary Examiner*—Clifford D. Crowder
*Assistant Examiner*—Larry D. Worrell, Jr.
*Attorney, Agent, or Firm*—Lane, Aitken & McCann

[57] ABSTRACT

A warp supplying apparatus comprising a warp gripping chuck for gripping a leading end portion of a warp thread, a cutter for cutting the leading end portion of the warp thread gripped by the warp gripping chuck, the cutter being provided above the warp gripping chuck, a suction nozzle that is provided below the warp gripping chuck and draws in a cut end portion of the warp thread cut by the cutter, a suction box provided between the warp gripping chuck and the suction nozzle for drawing in and guiding the cut end portion to the suction nozzle, the suction box being formed with a suction chamber and a slit through which the cut end portion is drawn in within the suction chamber by suction, and a warp conveying unit for conveying the cut end portion within the suction chamber from the warp gripping chuck to the suction nozzle. The suction box has a rear wall opposed to the slit and is formed with a pair of spaced side walls extending from the slit toward the rear wall to form a guide passageway for guiding the cut end portion to the rear wall of the suction box.

4 Claims, 27 Drawing Sheets

WARP SUPPLYING APPARATUS FOR A WARP THREADING MACHINE

FIELD OF THE INVENTION

The present invention relates to a warp supplying apparatus, and more particularly to such an apparatus that is provided in a threading machine for threading heddles or droppers.

DESCRIPTION OF THE PRIOR ART

A conventional warp supplying apparatus is shown in FIGS. 26–29 by way of example. The conventional warp supplying apparatus comprises a warp beam 1 on which a plurality of warp threads 2 are wound. The warp threads 2 are arranged in parallel along the axial direction of the warp beam 1 and held by a pair of warp tightening beams 3 and 4, as shown in FIG. 28. A suction box 5 extending along the warp thread 2 is provided and formed with a slit 6 extending therethrough. The slit 6, as shown in FIG. 28, is open to a rectangular suction chamber 5*b* of the suction box 5. The suction box 5 is connected at the predetermined positions thereof with vacuum nozzles 8*a*, 8*b* and 8*c* through conduits 7*a*, 7*b* and 7*c*. When the foremost warp thread 2 opposed to the slit 6 of the suction box 5 is cut at the leading end portion 2*a* thereof by a cutter 9 and moved toward the suction box 5 by a warp chuck 10, the warp thread 2 is to be drawn in within the suction box 5 through the slit 6 by suction.

The warp thread 2 drawn in toward the suction box 5 by suction is held by a warp holding bar 11 and, as shown in FIG. 28, is supplied to the slit 6 by a hooked portion 12*a* of a warp holding hook 12 provided in the vicinity of the warp holding bar 11. The warp thread 2 is then drawn in within the suction box 5 through the slit 6, and is lowered by a warp lowering hook 15 fixed on a timing belt 14 driven by a pair of pulleys 13*a* and 13*b*, as shown in FIG. 27. The cut end 2*b* of the warp thread 2 is passed through an eye of a heddle 18 through a nozzle passageway 16*a* of a suction nozzle 16 and through a nozzle passageway 17*a* of a guide nozzle 16. Thereafter, the warp holding bar 11 is rotated downward about a pin 11*a* and into the position indicated by the dotted line in FIG. 26, and the holding of the warp thread 2 by the warp holding bar 11 is released. Reference numerals 19*a* and 19*b* are warp separating tubes through which warp separating strings Y1 and Y2 are passed and which separates a foremost warp thread 2 from a plurality of warp threads.

However, the conventional warp supplying apparatus described above has its disadvantage in that it is difficult to guide the leading end 2*b* of the warp thread 2 into the suction nozzle 16, since the suction box 5 has a rectangular suction chamber 5*b*. That is, if the warp thread 2 can be guided along a rear wall 5*a* of the suction box 5, the warp thread end 2*b* can be guided into the suction nozzle 16. However, because of the rectangular configuration of the suction chamber 5*b*, it is difficult to guide the warp thread end 2*b* into the suction nozzle 16 along the suction box wall 5*a*. The conventional warp supplying apparatus has also its disadvantage in that the warp thread 2 located between the warp holding bar 11 and the warp lowering hook 15 is drawn in within the suction box 5 through the slit 6, since the suction force by which the warp thread 2 is directly drawn in within the suction box 5 is relatively strong. For this reason, the warp thread 2 comes off from the warp lowering hook 15, so it is difficult to guide the warp thread end 2*b* into the suction nozzle 16. The conventional warp supplying apparatus has further its disadvantage in that the foremost warp thread 2 tangles with the following warp threads and comes off from the warp lowering hook 15, since the conventional warp supplying apparatus does not have separating means for separating a warp thread one by one from among a plurality of warp threads arranged in parallel. As a result, it is also difficult to guide the warp thread end 2*b* into the suction nozzle 16.

It is, accordingly, an important object of the present invention to provide a warp supplying apparatus which is capable of easily supplying a warp thread to the suction nozzle of a threading machine.

It is another important object of the present invention to provide a warp supplying apparatus which is capable of easily separating a warp thread one by one from among a plurality of warp thread and supplying the separated warp thread to the suction nozzle of a threading machine.

SUMMARY OF THE INVENTION

In accordance with one important aspect of the present invention, there is provided a warp supplying apparatus comprising warp gripping means for gripping a leading end portion of a warp thread, the warp thread being supported by upper and lower horizontal beams, cutting means for cutting the leading end portion of the warp thread gripped by the warp gripping means, the cutting means being provided above the warp gripping means, a suction nozzle that is provided below the warp gripping means and draws in a cut end portion of the warp thread cut by the cutting means, and a suction box provided between the warp gripping means and the suction nozzle for drawing in and guiding the cut end portion of the warp thread to the suction nozzle. The suction box is formed with a suction chamber and a slit through which the cut end portion of the warp thread is drawn in within the suction chamber by suction. The warp supplying apparatus further comprises warp conveying means for conveying the cut end portion of the warp thread within the suction chamber from the warp gripping means to the suction nozzle. The suction box has a rear wall opposed to the slit and is formed with a pair of spaced side walls extending from the slit toward the rear wall to form a guide passageway for guiding the cut end portion of the warp thread to the rear wall of the suction box.

In accordance with another important aspect of the present invention, there is provided a warp supplying apparatus comprises warp gripping means for gripping a leading end portion of a warp thread, the warp thread being supported by upper and lower horizontal beams, cutting means for cutting the leading end portion of the warp thread gripped by the warp gripping means, the cutting means being provided above the warp gripping means, and a suction nozzle that is provided below the warp gripping means and draws in a cut end portion of the warp thread cut by the cutting means. The warp supplying apparatus further comprises a suction box provided between the warp gripping means and the suction nozzle for drawing in and guiding the cut end portion of the warp thread to the suction nozzle, the suction box being formed with a suction chamber and a slit through which the cut end portion of the warp thread is drawn in within the suction chamber by suction, warp conveying means for conveying the cut end portion of the warp thread within the suction chamber from the warp gripping means to the suction nozzle, warp holding means provided in the vicinity of the warp conveying means for engaging the warp thread conveyed to the suction nozzle by the warp conveying means and holding the warp thread at a predetermined position, and a pair of plates mounted on the suction box so that they are spaced a predetermined distance from the suction box and extend along the slit from the warp holding means to the vicinity of the suction nozzle and are spaced from each other across the slit.

The predetermined distance between the plates and the suction box is longer than a width of the slit of the suction box.

In accordance with still another important aspect of the present invention, there is provided a warp supplying apparatus comprising a plurality of warp threads wound on a warp beam, parallel holding means to hold the plurality of warp threads so that they are arranged in parallel along an axial direction of the warp beam, cutting means for cutting a leading end portion of a foremost warp thread of the plurality of warp threads arranged in parallel by the parallel holding means, and suction and guide means for drawing in a cut end portion of the foremost warp thread cut by the cutting means and for guiding the cut end portion to a first position spaced a first predetermined distance from the plurality of warp threads. The warp supplying apparatus further comprises intermediate holding means provided between the plurality of warp threads and the suction and guide means for holding an intermediate portion of the foremost warp thread in a second position spaced a second predetermined distance from the plurality of warp threads, warp conveying means that engages with a portion of the foremost warp thread between the intermediate holding means and the suction and guide means and conveys the cut end portion of the foremost warp thread drawn in within the suction and guide means in a direction opposite to the drawing-in direction of the suction and guide means, the cut end portion of the foremost thread being supplied to a third position by moving the warp conveying means in the opposite direction with respect to the intermediate holding means, and a separation member provided between the plurality of warp threads and the intermediate holding means for separating the foremost warp thread from the plurality of warp threads by moving in a direction in which the warp conveying means moves. The intermediate portion of the foremost warp thread is fixedly held by the intermediate holding means, when the separation member is moved in the opposite direction.

BRIEF DESCRIPTION OF THE DRAWINGS

The drawbacks of a conventional warp supplying apparatus and the features and advantages of a warp supplying apparatus according to the present invention will be more clearly understood from the following description taken in conjunction with the accompanying drawings in which.

DESCRIPTION OF THE PREFERRED EMBODIMENTS

Referring now in greater detail to the drawings and initially to FIGS. 1-7, there is shown a first embodiment of a warp supplying apparatus in accordance with the present invention.

Figure 1:
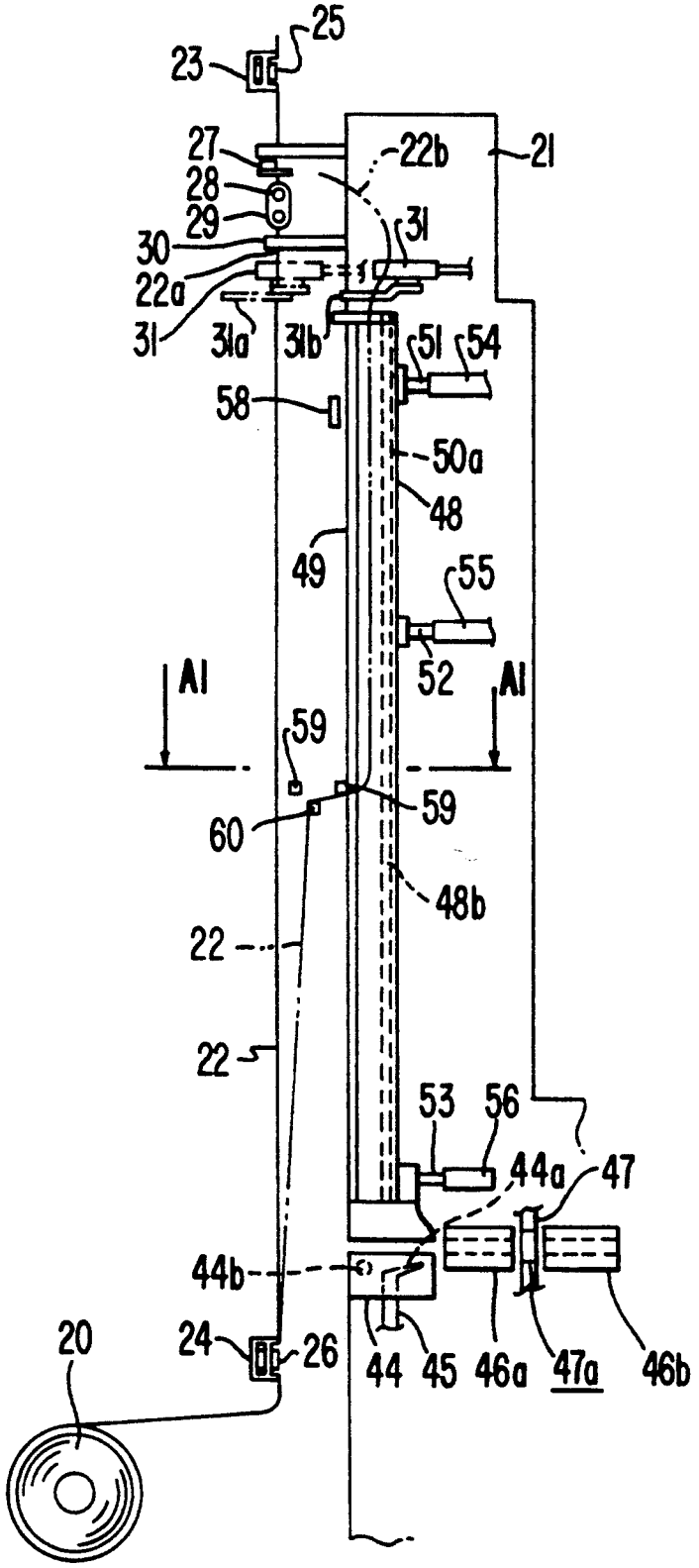
FIG. 1 is a side elevational view showing a first embodiment of the warp supplying apparatus according to the present invention.
Figure 2:
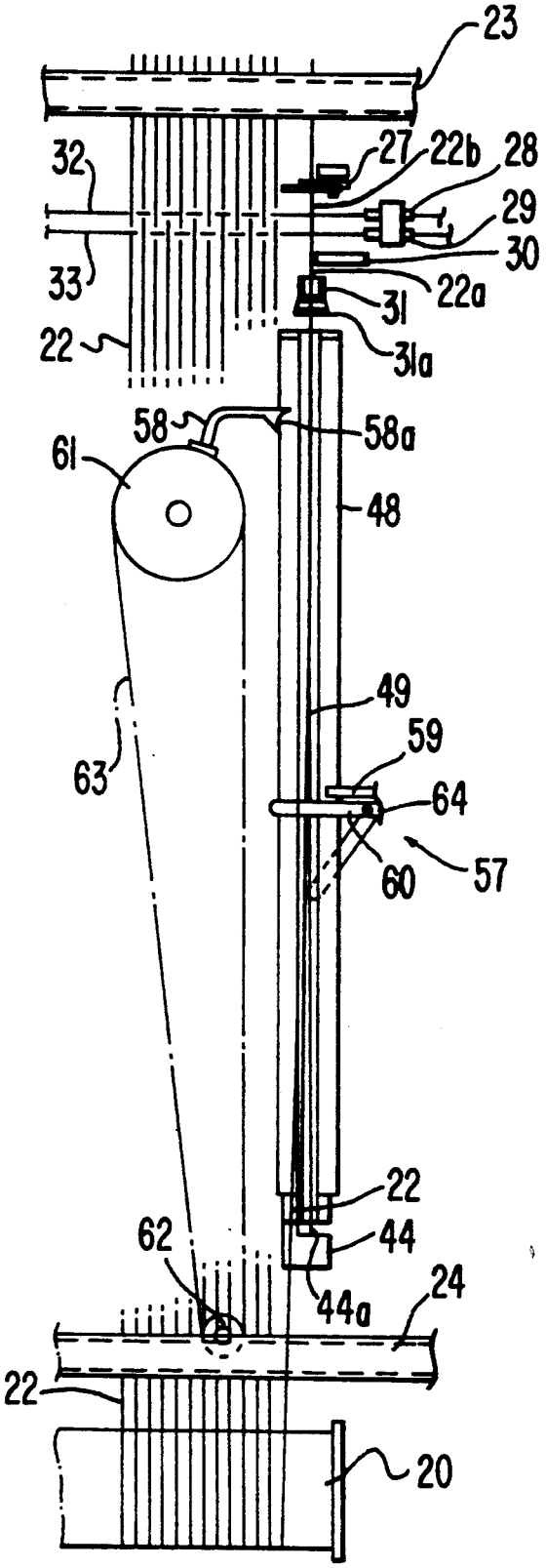
FIG. 2 is a front elevational view showing the first embodiment of FIG. 1.

In FIGS. 1 and 2, reference numeral 20 denotes a warp beam which is supported on a back frame (not shown) disposed in the vicinity of a vertical frame 21 of a threading machine and on which a plurality of warp threads 22 are wound. The warp threads, as shown in FIG. 2, are supported by a pair of warp tightening beams 23 and 24 and arranged in parallel along the axial direction of the warp beam 20. Reference numerals 25 and 26 are gripping plates, respectively, which are inserted into grooves of the warp tightening beams 23 and 24. The gripping plates 25 and 26 grip the warp threads 22, together with the warp tightening beams 23 and 24.

The warp tightening beams 23 and 24 are moved toward and away from each other by drive means (not shown) so that the warp threads 22 can be tightened. A cutter 27, warp separating tubes 28, 29 through which warp separating strings 32 and 33 are passed, a separation nozzle 30, and a warp chuck 31 (warp-end gripping means) are provided in the upper portion of the vertical frame 21. The warp separating tubes 28, 29 and the separation nozzle 30 are adapted to separate a foremost warp thread from among the warp threads 22 arranged in parallel along the axial direction of the warp beam 20. The foremost warp thread 22 is easily separated by horizontally rotating the warp separating tubes 180°.

The separated warp thread 22 is moved to the central portion of a warp chuck 31 by the separation nozzle 30. The warp chuck 31 comprises a suction nozzle portion and a warp gripping portion 31*a*. When the warp chuck 31 is moved by drive means (not shown) to the position indicated by the dotted line of FIG. 1, the warp thread 22 is drawn in by the suction nozzle portion and gripped by the gripping portion 31*a*. The warp thread 22 gripped by the warp chuck 31 is cut at the end portion 22*a* thereof by the cutter 27 provided between the upper horizontal beam 23 and the upper warp separating tube 28. A cut end portion 22*b* of the warp thread 22 formed by the cutter 27 is released from the upper horizontal beam 23.

A suction nozzle 44 is disposed below the warp chuck 31 and provided in the vertical frame 21 and connected with a conduit 45 through which compressed air is introduced from a source of compressed air (not shown). The suction nozzle 44 is formed with a nozzle passageway 44*a* along which the compressed air is supplied. If the cut end portion 22*b* of the warp thread 22 cut by the cutter 27 is guided to the suction nozzle 44, it will be drawn in and advanced along the nozzle passageway 46*a* by the injector effect of the compressed air. After the warp thread end portion 22*b* has been passed through the suction nozzle 44 and a first guide nozzle 46*a*, it is passed through an eye 47*a* of a heddle 47 positioned the first guide nozzle 46*a* and a second guide nozzle 46*b*. Reference numeral 44*b* denotes a compressed-air supplying portion which supplies compressed air toward the nozzle passageway 44*a* so that the warp thread end portion 22*b* can be easily drawn in within the nozzle passageway 44*a*.

Figure 3:
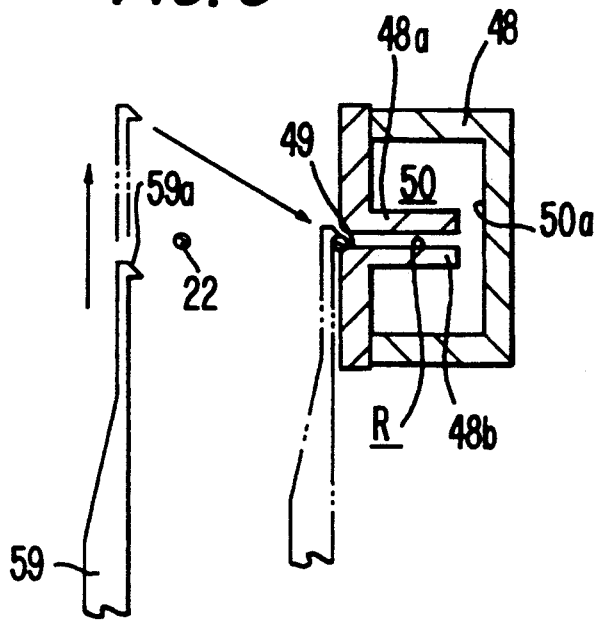
FIG. 3 is a sectional view taken substantially along line A1—A1 of FIG. 1.

A vertically extending suction box 48 with a vertical slit 49 vertically extending therethrough is provided between the warp chuck 31 and the suction nozzle 44. The vertical slit 49, as shown in FIG. 3, is open to a suction chamber 50 of the suction nozzle 44. The suction nozzle 44 is further formed with a pair of side walls 48*a* and 48*b*, which extend from the vertically extending slit 49 toward a rear wall 50*a* of the suction box 44 to form an air passageway R for guiding the warp thread 22 to the rear wall 50*a*.

The suction chamber 50 of the suction box 48 is connected at the upper portion thereof with a vacuum nozzle 51, at the intermediate portion with a vacuum nozzle 52 and at the lower portion with a vacuum nozzle 53. The vacuum nozzles 51, 52 and 53 are connected with a source of vacuum (not shown) through conduits 54, 55 and 56. When air is drawn in within the suction chamber 50 through the vertical slit 49 of the suction box 48, the warp thread 22 is moved to the vertical slit 49 and drawn in within the suction chamber 50 through the air passageway R. The warp thread 22 cut by the cutter 27 is guided by the suction box 48 and lowered to the suction nozzle 44. At this time, the warp thread 22 within the suction chamber 50 is held upward in a straight state with a predetermined tension along the rear wall 50*a* of the chamber 50, because the air from the air passageway R to the rear wall 50*a* flows upward by the vacuum nozzles 51, 52 and 53.

Reference numeral 57 denotes warp conveying means that grips the warp thread 22 cut by the cutter 27 and conveys the warp thread 22 within the suction box 48 from the warp chuck 31 to the suction nozzle 44. The warp conveying means 57 comprises a warp lowering hook 58, a warp holding hook 59 and a warp holding bar 60. The warp lowering hook 58 is formed into a substantially L shape and has a proximal portion fixedly mounted on a timing belt 63 which is driven by a large pulley 61 and a small pulley 62. The warp lowering hook 58 also has a grooved portion 58*a* at the distal portion thereof.

If the small pulley 62 is rotated in one direction by drive means (not shown), the grooved portion 58*a* of the warp lowering hook 58 is lowered along the vertical slit 49 of the suction box 48 to the vicinity of the lower horizontal beam 24. If, on the other hand, the small pulley 62 is rotated in the other direction, the grooved portion 58*a* of the warp lowering hook 58 is raised and returns back to its original position. The warp holding hook 59 is provided between the warp thread 22 and the suction box 48 and in the longitudinal central portion of the suction box 48. The warp holding hook 59 has a distal portion formed with a hooked portion 59*a*, as shown in FIG. 3, and also has a proximal portion which is drive to move in the up and down directions and in the right and left directions of FIG. 3 by a drive mechanism (not shown).

If the end portion 22*a* of the warp thread 22 is gripped by the warp chuck 31 and cut by the cutter 27 and the warp chuck 31 is moved back, the warp holding hook 59 is moved upward and then in the right direction so that the warp thread 22 is guided to the vertical slit 49 of the suction box 48, as shown in FIG. 3. At this time, the warp thread 22 is gripped by the hooked portion 59a of the warp holding hook 59, and the cut end portion 22b of the warp thread 22 guided to the vertical slit 49 of the suction box 48 is drawn in within the suction chamber 50 through the vertical slit 49 and the air passageway R.

Figure 6:
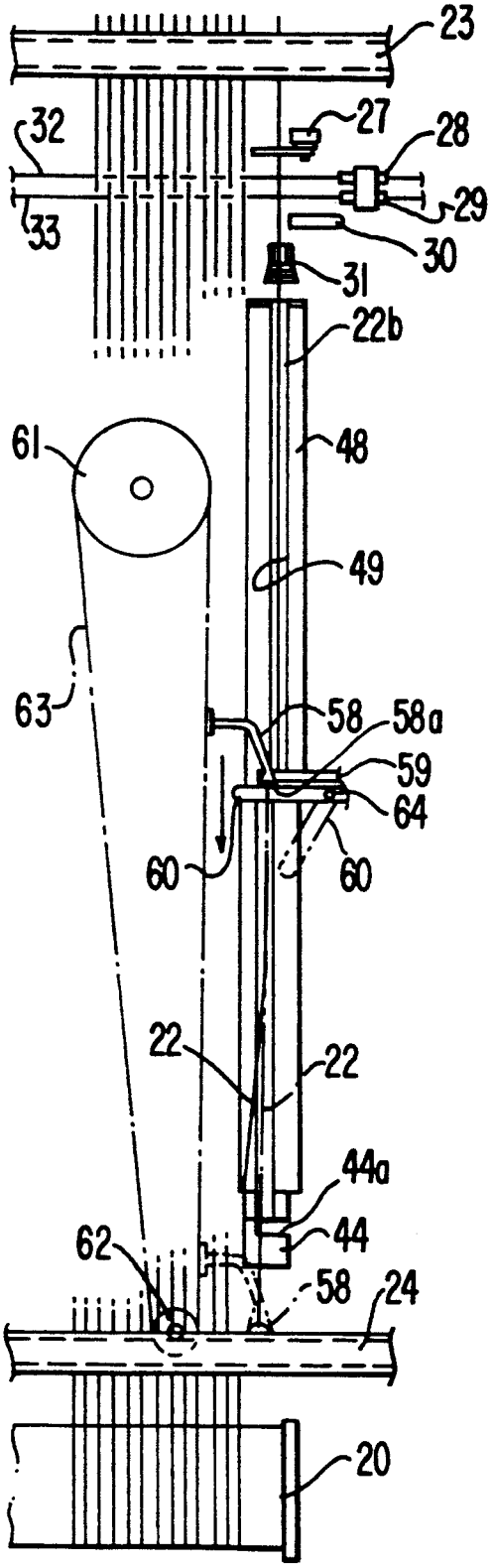
FIG. 6 is a front elevational view showing how the warp thread is lowered along the suction box through the bridge portion of the warp thread shown in FIG. 5.

The warp holding bar 60 is also provided between the warp thread 22 and the suction box 48 and in the vicinity of the warp holding hook 59. The warp holding bar 60 is freely rotatably supported on the frame 21 through a pin 64 and is normally held in a horizontal position. If, as shown in FIG. 6, the grooved portion 58a of the warp lowering hook 58 is lowered along the vertical slit 49 and grips the warp thread 22 located between the warp holding bar 60 and the suction box 48 and is further lowered in the vicinity of the lower horizontal beam 24, then the warp holding bar 60 is rotated downward about the pin 64, and the holding of the warp thread 22 between the bar 60 and the lower beam 24 is released. The released wrap thread 22 is to be passed through the heddle 47 through the suction nozzle 44.

The operation of the warp supplying apparatus in accordance with the first embodiment of the present invention will hereinafter be described.

In FIGS. 1 and 2, the warp threads 22 unwound from the warp beam 20 are held between the upper and lower horizontal beams 23 and 24. If the foremost warp thread 22 is separated by rotations of the warp separating tubes 28 and 29, then the separation nozzle 30 advances to grip the end portion 22a of the foremost warp thread 22. The warp thread end portion 22a gripped by the separation nozzle 30 is moved to the central portion of the warp chuck 31, as shown in FIG. 2. The warp chuck 31 is then moved from the position indicated by the solid line in FIG. 1 to the position indicated by the dotted line in order to grip the warp thread end portion 22a.

Figure 4:
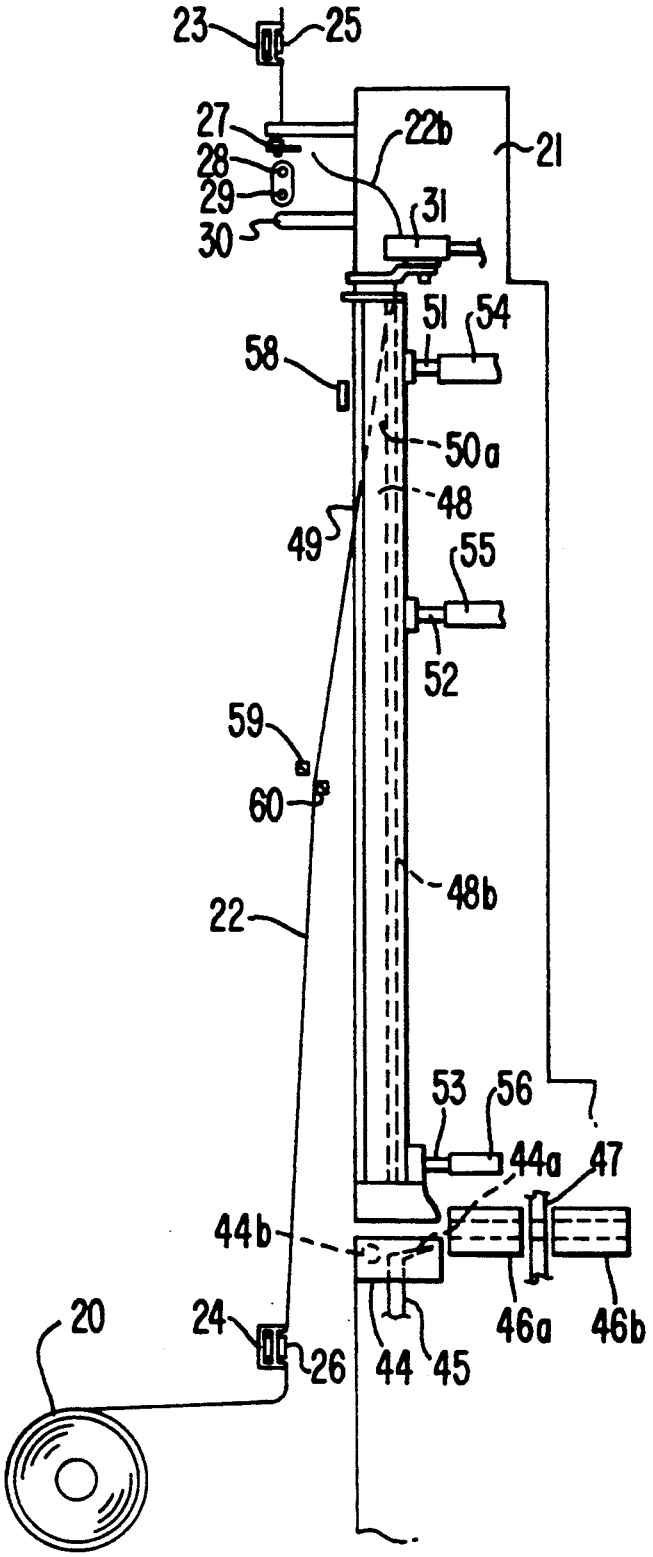
FIG. 4 is a side elevational view showing the first embodiment of FIG. 1 in which the leading end portion of the warp thread is moved toward the suction box.

If the thread end portion 22a gripped by the warp chuck 31 is cut by the cutter 27, then the cut end portion 22b gripped by the warp chuck 31 is moved toward the suction box 48, as shown in FIG. 4. As a result, the warp thread 22 is supported at its intermediate portion on the warp holding bar 60, and the upper half portion of the warp thread 22 between the warp holding bar 60 and the warp chuck 31 is drawn in within the suction box 48 through the vertical slit 49 and the air passageway R.

Figure 5:
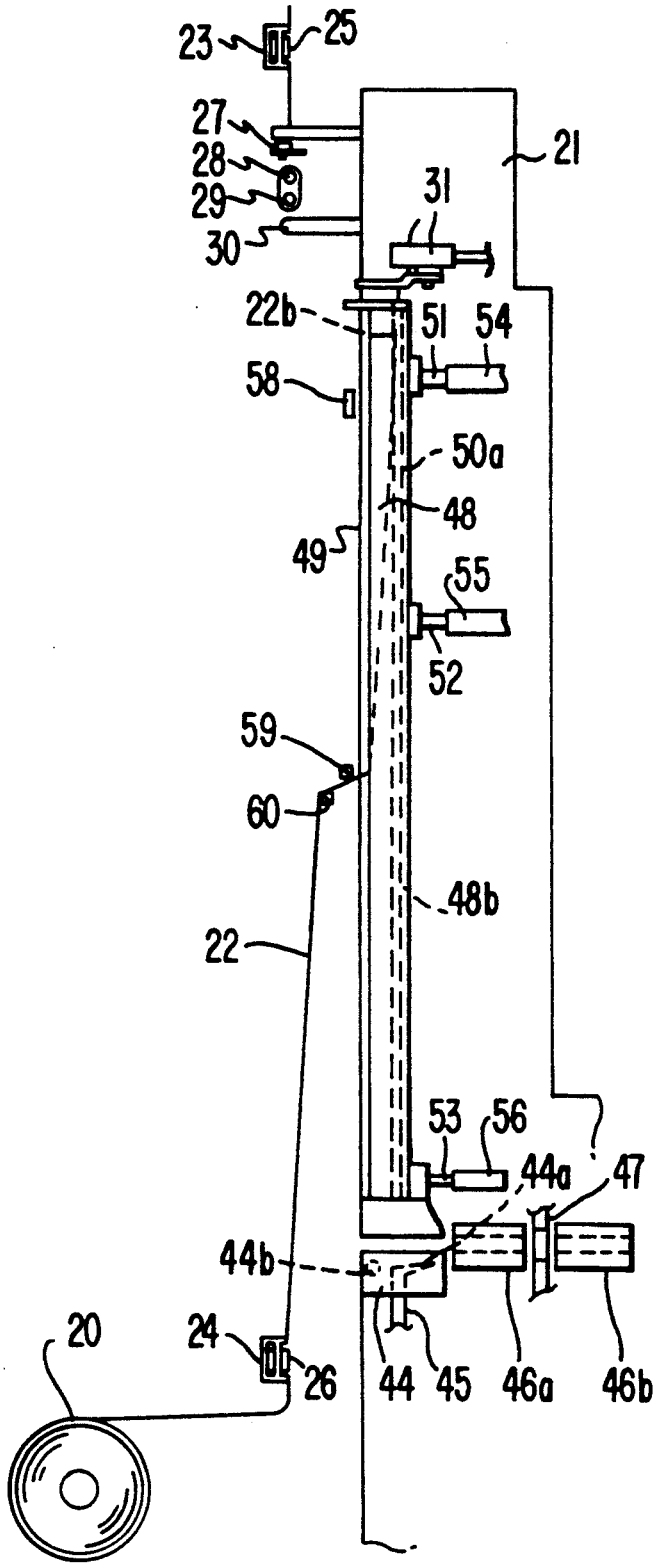
FIG. 5 is a view similar to FIG. 4 but showing the leading end portion of the warp thread drawn in within the suction box by suction and a bridge portion formed in the longitudinal central portion of the warp thread.

On the other hand, the warp holding hook 59, as shown in FIG. 3, advances upward and then moves toward the vertical slit 49 of the suction box 48, so that the warp thread 22 is guided to the vertical slit 49 by the hooked portion 59a of the warp holding hook 59. When this occurs, the warp thread 22 within the suction chamber 50 is held in its straight state along the suction chamber wall 50a with a predetermined tension, because air flows from the air passageway R to the suction chamber wall 50a and flows upward by the vacuum nozzles 51, 52 and 53. As shown in FIG. 5, the large part of the warp thread 22 between the warp holding hook 59 and the warp chuck 31 is then drawn in within the suction box 48, and a bridge portion is formed between the warp holding hook 59 and the warp holding bar 60 held in its horizontal position.

Figure 7:
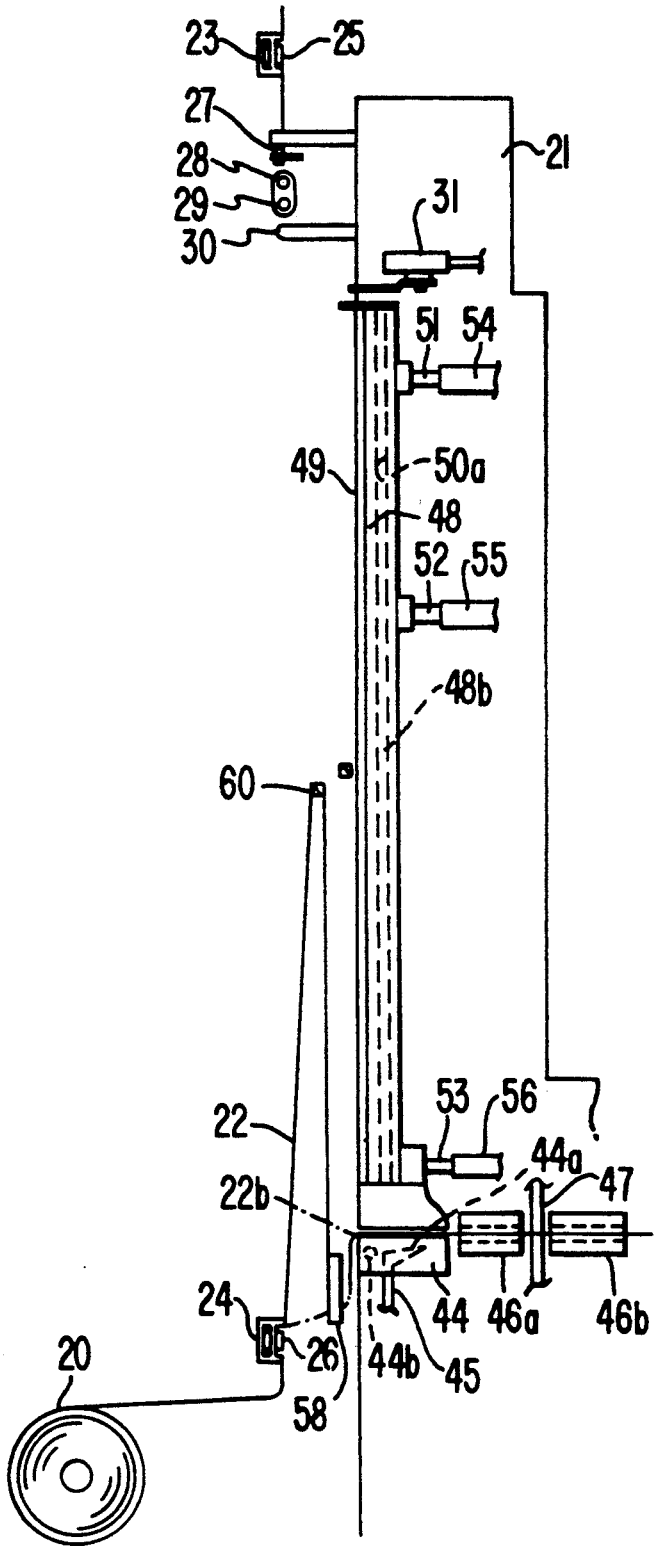
FIG. 7 is a view similar to FIG. 5 but showing the leading end portion of the warp thread lowered along the suction box.

As shown in FIG. 6, as the small pulley 62 is rotated, the warp lowering hook 58 is lowered along the vertical slit 49 of the suction box 48, so that the bridge portion between the warp holding hook 59 and the warp holding bar 60 is gripped by the grooved portion 58a of the warp lowering hook 58 and is lowered toward the suction nozzle 44. If, as shown in FIG. 7, the grooved portion 58a is lowered beyond the suction nozzle 44, the cut thread end portion 22b is guided by the suction nozzle 44 and the warp thread 22 is guided into the nozzle passageway 44a of the suction nozzle 44 by suction. At this time, since the cut thread end portion within the suction box 48 is urged upward along the rear wall 50a, the thread 22 is always moved along the rear wall 50a during the time that the thread 22 is lowered beyond the suction nozzle 44 by the warp lowering hook 58. For this reason, the leading end portion of the warp thread 22 is guided to the inlet portion of the nozzle passageway 44a of the suction nozzle 44, and is drawn in within the nozzle passageway 44a by the compressed-air supplying portion 44b. The warp thread 22 is then passed through the eye 47a of the heddle 47 through the suction nozzle 44 and the guide nozzle 46a. At the same time, as shown in FIG. 6, the warp holding bar 60 is rotated downward about the pin 64 and therefore the warp thread 22 is released from the warp holding bar 60. The warp thread 22 extending from the lower horizontal beam 24 is then passed through the eye 47a of the heddle 47, and the threading operation is complete.

As described above, in the first embodiment of the present invention, the suction box 48 is provided with the side walls 48a and 48b, which extend from the vertical slit 49 toward the rear wall 50a of the suction box 48 to form the air passageway R for guiding the warp thread 22 to the rear wall 50a. Therefore, air flowing upward along the rear wall 50a can be generated within the suction chamber 50, and when the warp thread within the suction chamber 50 is guided to the suction nozzle 44 by the warp lowering hook 58, the warp thread can be lowered along the rear wall 50a and guided to the suction nozzle 44. For this reason, the position of the warp thread end portion 22b within the suction box 48 can be stabilized and the thread end portion 22b can be guided to the suction nozzle 44a easily and certainly. As a result, a threding machine can be operated at high speeds.

FIGS. 8–15 illustrate a second embodiment of the warp supplying apparatus in accordance with the present invention.

Figure 8:
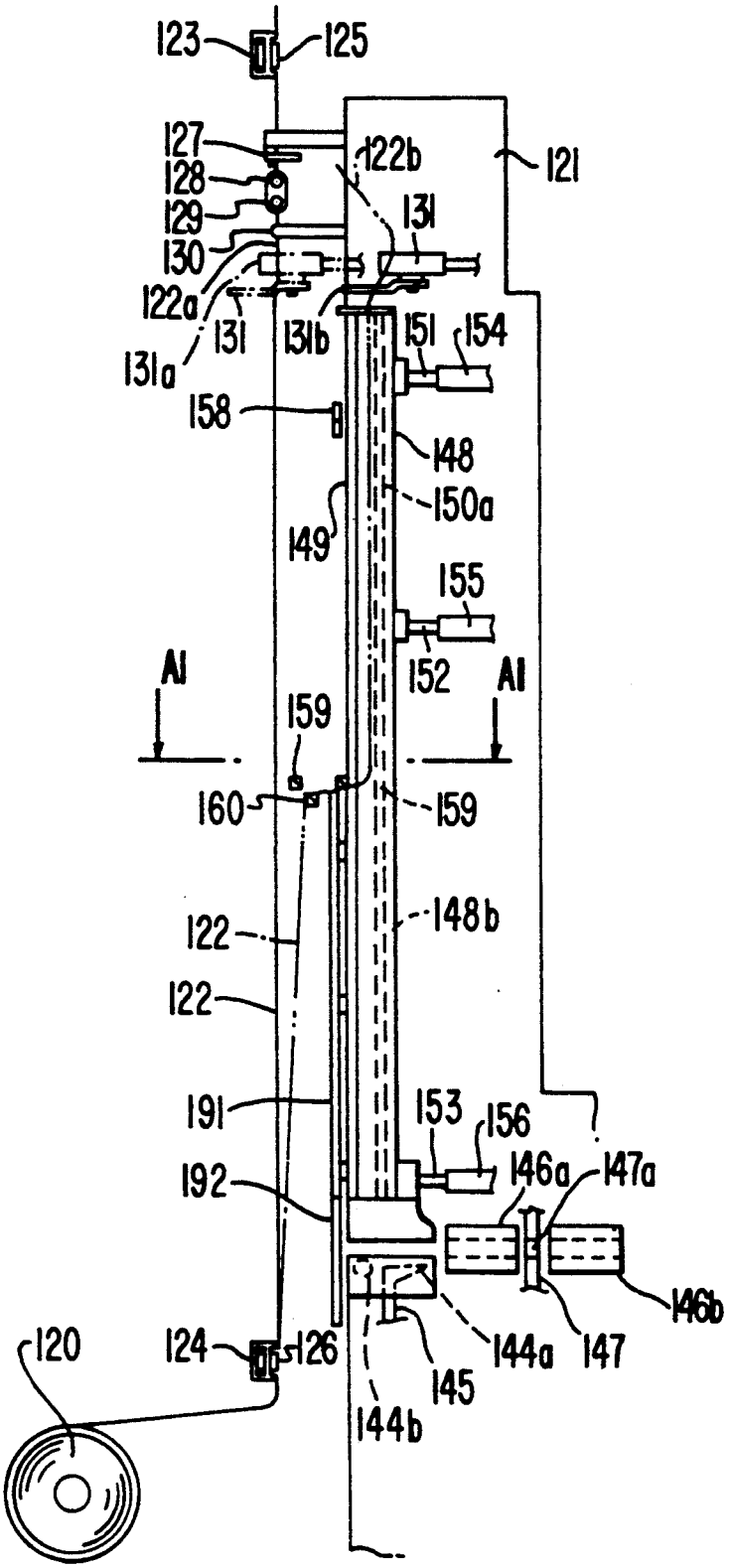
FIG. 8 is a side elevational view showing a second embodiment of the warp supplying apparatus according to the present invention.
Figure 9:
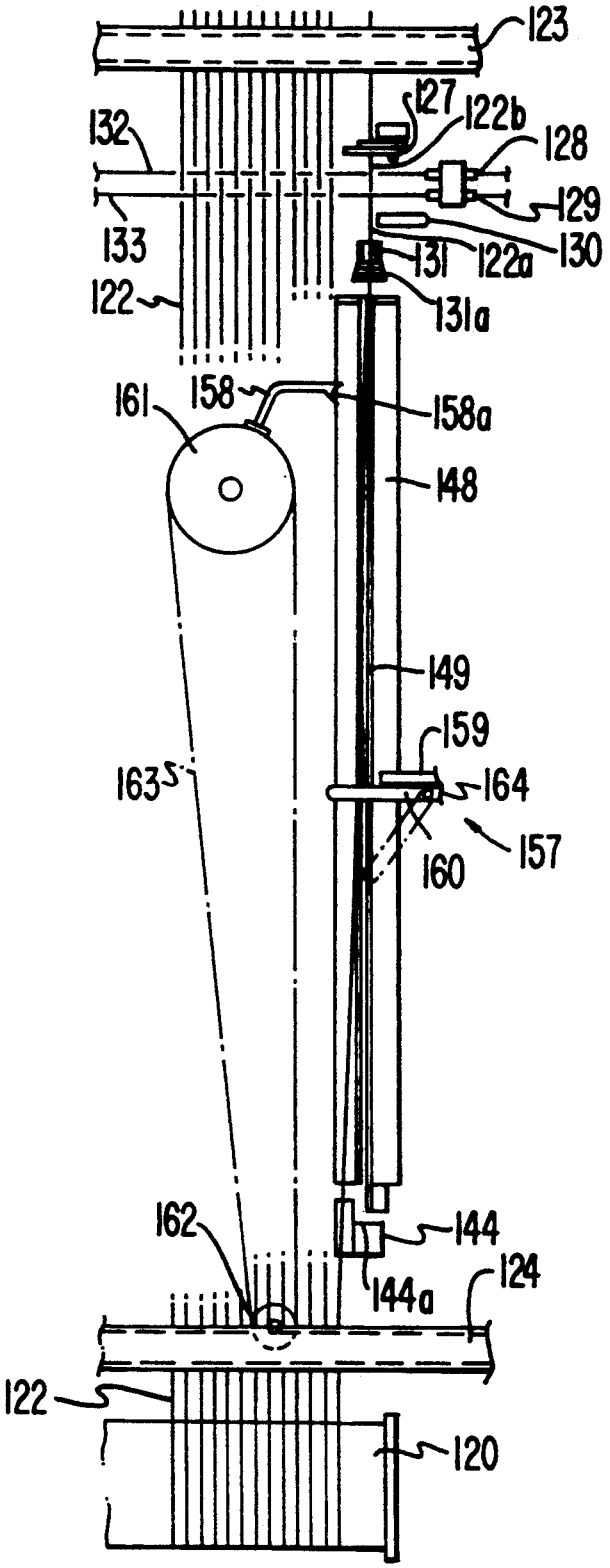
FIG. 9 is a front elevational view showing the second embodiment of FIG. 8.

In FIGS. 8 and 9, reference numeral 120 denotes a warp beam which is supported on a back frame (not shown) disposed in the vicinity of a vertical frame 121 of a threading machine and on which a plurality of warp threads 122 are wound. The warp threads, as shown in FIG. 9, are supported by a pair of warp tightening beams 123 and 124 and arranged in parallel along the axial direction of the warp beam 120. Reference numerals 125 and 126 are gripping plates, respectively, which are inserted into grooves of the warp tightening beams 123 and 124. The gripping plates 125 and 126 grip the warp threads 122, together with the warp tightening beams 123 and 124.

The warp tightening beams 123 and 124 are moved toward and away from each other by drive means (not shown) so that the warp threads 122 can be tightened. A cutter 127, warp separating tubes 128, 129 through which warp separating strings 132 and 133 are passed, a separation nozzle 130, and a warp chuck 131 (warp-end gripping means) are provided in the upper portion of the vertical frame 121. The warp separating tubes 128, 129 and the separation nozzle 130 are adapted to separate a foremost warp thread from among the warp threads 122 arranged in parallel along the axial direction of the warp beam 120. The foremost warp thread 122 is easily separated by horizontally rotating the warp separating tubes 180°.

The separated warp thread 122 is moved to the central portion of a warp chuck 131 by the separation nozzle 130. The warp chuck 131 comprises a suction nozzle portion and a warp gripping portion 131*a*. When the warp chuck 131 is moved by drive means (not shown) to the position indicated by the dotted line of FIG. 8, the warp thread 122 is drawn in by the suction nozzle portion and gripped by the gripping portion 131*a*. The warp thread 122 gripped by the warp chuck 131 is cut at the end portion 122*a* thereof by the cutter 127 provided between the upper horizontal beam 123 and the upper warp separating tube 128. A cut end portion 122*b* of the warp thread 122 is released from the upper horizontal beam 123.

A suction nozzle 144 is disposed below the warp chuck 131 and provided in the vertical frame 121 and connected with a conduit 145 through which compressed air is introduced from a source of compressed air (not shown). The suction nozzle 144 is formed with a nozzle passageway 144*a* along which the compressed air is supplied. If the cut end portion 122*b* of the warp thread 122 cut by the cutter 127 is guided to the suction nozzle 144, it will be drawn in and advanced along the nozzle passageway 146*a* by the injector effect of the compressed air. After the warp thread end portion 122*b* has been passed through the suction nozzle 144 and a first guide nozzle 146*a*, it is passed through an eye 147*a* of a heddle 147 positioned the first guide nozzle 146*a* and a second guide nozzle 146*b*. Reference numeral 144*b* denotes a compressed-air supplying portion which supplies compressed air toward the nozzle passageway 144*a* so that the warp thread end portion 122*b* can be easily drawn in within the nozzle passageway 144*a*.

Figure 10:
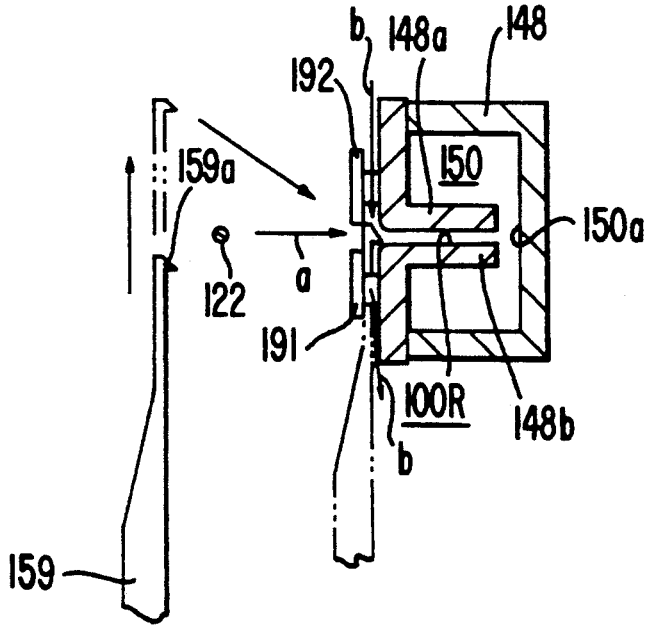
FIG. 10 is a sectional view taken substantially along line A1—A1 of FIG. 8.

A vertically extending suction box 148 with a vertical slit 149 vertically extending therethrough is provided between the warp chuck 131 and the suction nozzle 144. The vertical slit 149, as shown in FIG. 10, is open to a suction chamber 150 of the suction nozzle 144. The suction nozzle 144 is further formed with a pair of side walls 148*a* and 148*b*, which extend from the vertically extending slit 149 toward a rear wall 150*a* of the suction box 144 to form an air passageway 100R for guiding the warp thread 122 to the rear wall 150*a*.

The suction chamber 150 of the suction box 148 is connected at the upper portion thereof with a vacuum nozzle 151, at the intermediate portion with a vacuum nozzle 152 and at the lower portion with a vacuum nozzle 153. The vacuum nozzles 151, 152 and 153 are connected with a source of vacuum (not shown) through conduits 154, 155 and 156. When air is drawn in within the suction chamber 150 through the vertical slit 149 of the suction box 148, the warp thread 122 is moved to the vertical slit 149 and drawn in within the suction chamber 150 through the air passageway R. The warp thread 122 cut by the cutter 127 is guided by the suction box 148 and lowered to the suction nozzle 144. At this time, the warp thread 122 within the suction chamber 150 is held upward in a straight state with a predetermined tension along the rear wall 150*a* of the chamber 150, because the air from the air passageway R to the rear wall 150*a* flows upward by the vacuum nozzles 151, 152 and 153.

Reference numeral 157 denotes warp conveying means that grips the warp thread 122 cut by the cutter 127 and conveys the warp thread 122 within the suction box 148 from the suction box 148, as shown in FIG. 10. At this time, the warp thread 122 is held by the hooked portion 159*a* of the warp holding hook 159, and the cut end portion 122*b* of the warp thread 122 guided to the vertical slit 149 of the suction box 148 is drawn in within the suction chamber 150 through the vertical slit 149 and the air passageway R.

The warp holding bar 160 is also provided between the warp thread 122 and the suction box 148 and in the vicinity of the warp holding hook 159. The warp holding bar 160 is freely rotatably supported on the frame 121 through a pin 164 and is normally held in a horizontal position. If the grooved portion 158*a* of the warp lowering hook 158 is lowered along the vertical slit 149 and grips the warp thread 122 located between the warp holding bar 160 and the suction box 148 and is further lowered in the vicinity of the lower horizontal beam 124, then the warp holding bar 160 is rotated downward about the pin 164, and the holding of the warp thread 122 between the bar 160 and the lower beam 124 is released. The released wrap thread 122 is to be passed through the heddle 147 through the suction nozzle 144.

Figure 11:
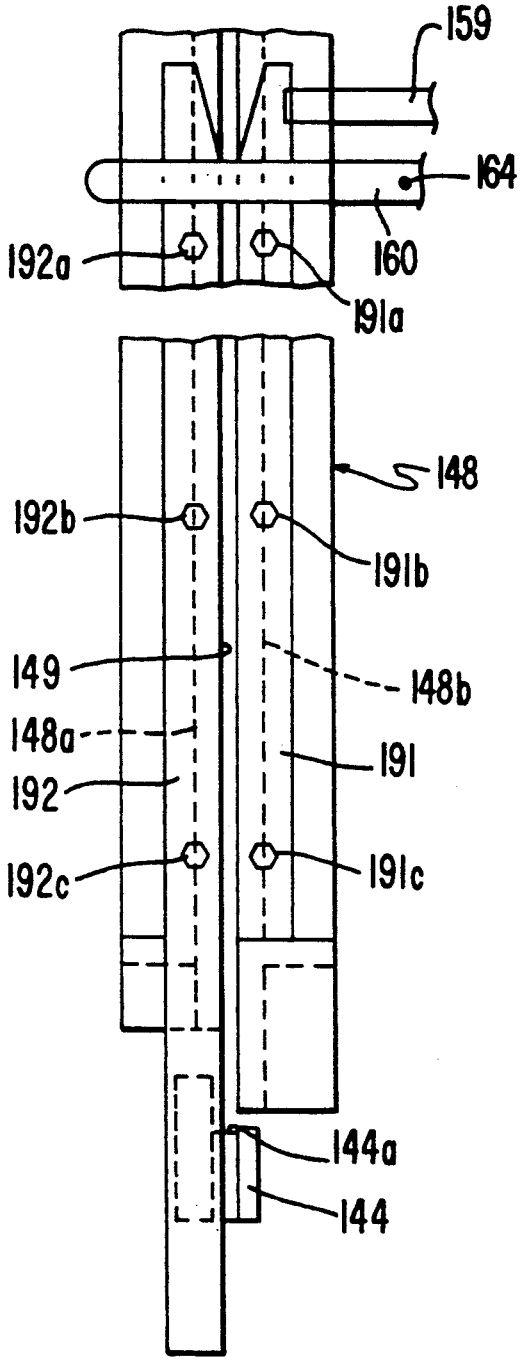
FIG. 11 is an enlarged front end view showing the lower half portion of the suction box of FIG. 8.

On the other hand, the suction box 148 is provided with a pair of spaced plates 191 and 192, as shown in FIG. 11. The plates 191 and 192 are spaced a predetermined distance from the suction box 148 and extend from the warp holding bar 160 to the vicinity of the suction nozzle 144 and are spaced apart from each other across the vertical slit 149. These plates 191 and 192 are fixed to the suction box 148 by means of screws 91*a*, 91*b*, 91*c*, 92*a*, 92*b*, and 92*c* so warp chuck 131 to the suction nozzle 144. The warp conveying means 157 comprises a warp lowering hook 158, a warp holding hook 159 and a warp holding bar 160. The warp lowering hook 158 is formed into a substantially L shape and has a proximal portion fixedly mounted on a timing belt 163 which is driven by a large pulley 161 and a small pulley 162. The warp lowering hook 158 also has a grooved portion 158*a* at the distal portion thereof.

If the small pulley 162 is rotated in one direction by drive means (not shown), the grooved portion 158*a* of the warp lowering hook 158 is lowered along the vertical slit 149 of the suction box 148 to the vicinity of the lower horizontal beam 124. If, on the other hand, the small pulley 162 is rotated in the other direction, the grooved portion 158*a* of the warp lowering hook 158 is raised and returns back to its original position. The warp holding hook 159 is provided between the warp thread 122 and the suction box 148 and in the longitudinal central portion of the suction box 148. The warp holding hook 159 has a distal portion formed with a hooked portion 159*a*, as shown in FIG. 10, and also has a proximal portion which is drive to move in the up and down directions and in the right and left directions of FIG. 10 by a drive mechanism (not shown).

If the end portion 122*a* of the warp thread 122 is gripped by the warp chuck 131 and cut by the cutter 127 and the warp chuck 131 is moved back, the warp holding hook 159 is moved upward and then in the right direction so that the warp thread 122 is guided to the vertical slit 149 of the that the predetermined distance from the suction box 148 becomes longer than the width of the vertical slit 149. For this reason, the air to be drawn in within the suction chamber 150 through the vertical slit 149 is dispersed between the plates 191 and 192 and also between the plates 191, 192 and the suction box 148, as shown by the arrows a, b and c in FIG. 10. Note that in FIG. 9 the plates 191 and 192 have been omitted for simplification.

The operation of the warp supplying apparatus in accordance with the second embodiment of FIGS. 8–15 will hereinafter be described.

In FIGS. 8 and 9, the warp threads 122 unwound from the warp beam 120 are held between the upper and lower horizontal beams 123 and 124. If the foremost warp thread 122 is separated by rotations of the warp separating tubes 128 and 129, then the separation nozzle 130 advances to grip the end portion 122*a* of the foremost warp thread 122. The warp thread end portion 122*a* gripped by the separation nozzle 130 is moved to the central portion of the warp chuck 131, as shown in FIG. 9. The warp chuck 131 is then moved from the position indicated by the solid line in FIG. 8 to the position indicated by the dotted line in order to grip the warp thread end portion 122*a*.

Figure 12:
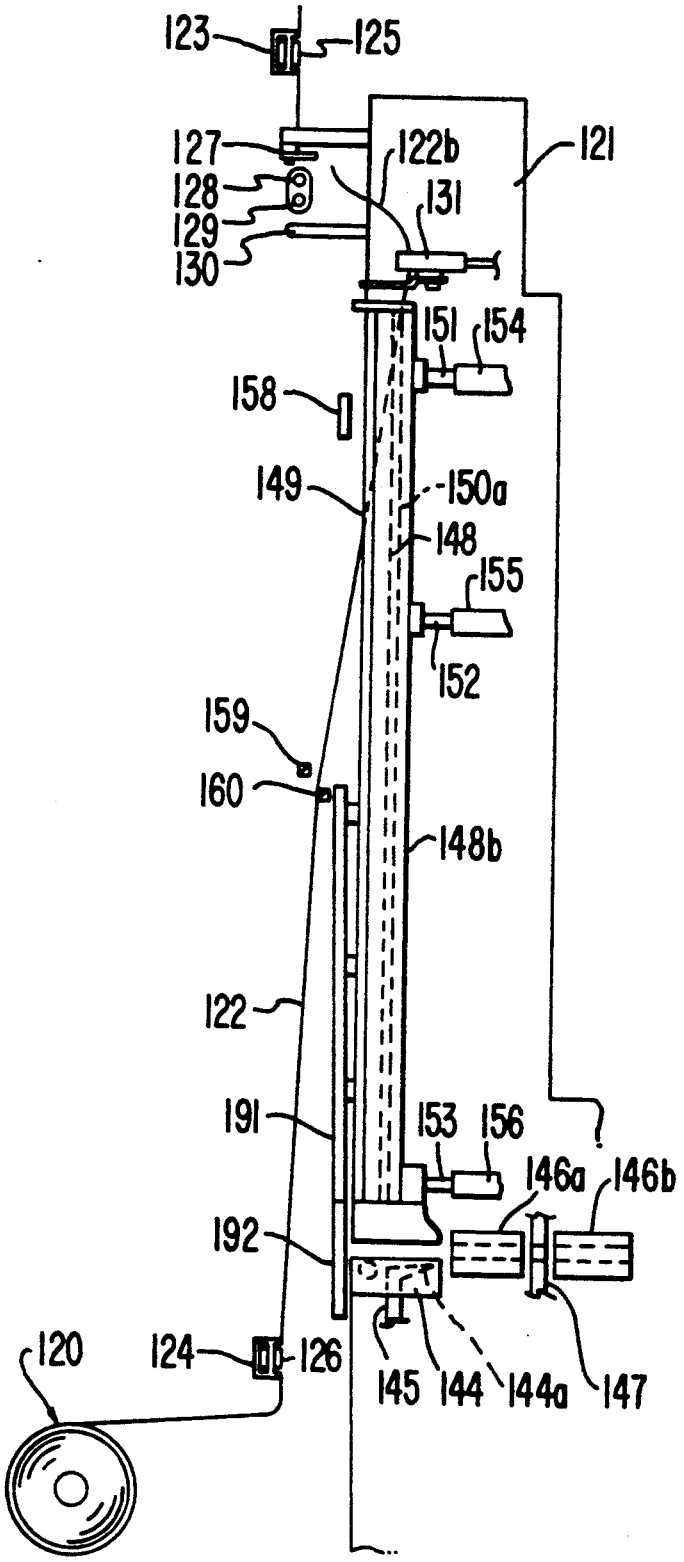
FIG. 12 is a side elevational view showing the second embodiment of FIG. 8 in which the leading end portion of the warp thread is moved toward the suction box.

If the thread end portion 122*a* gripped by the warp chuck 131 is cut by the cutter 127, then the cut end portion 122*b* gripped by the warp chuck 131 is moved toward the suction box 148, as shown in FIG. 12. As a result, the warp thread 122 is supported at its intermediate portion on the warp holding bar 160, and the upper half portion of the warp thread 122 between the warp holding bar 160 and the warp chuck 131 is drawn in within the suction box 148 through the vertical slit 149 and the air passageway R.

Figure 13:
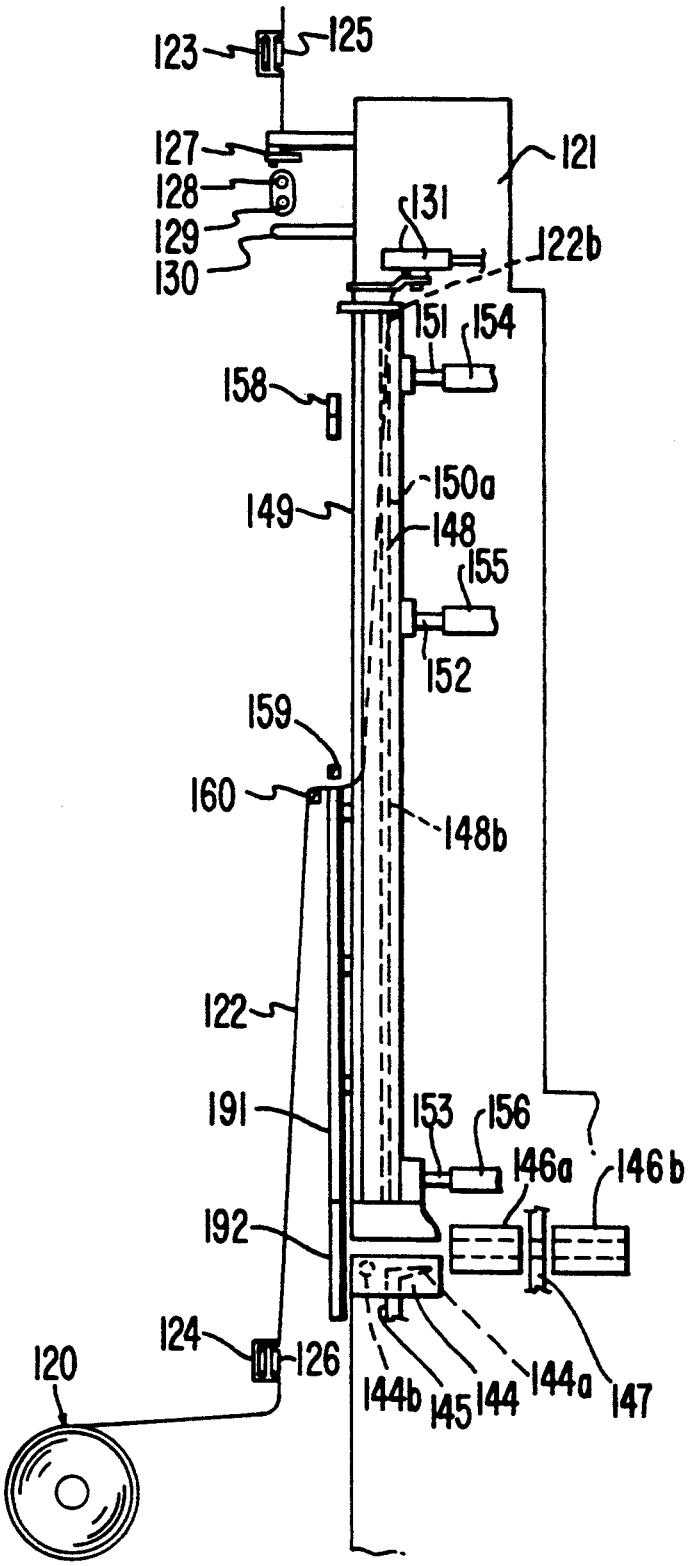
FIG. 13 is a view similar to FIG. 12 but showing the leading end portion of the warp thread drawn in within the suction box by suction and a bridge portion formed in the longitudinal central portion of the warp thread.

On the other hand, the warp holding hook 159, as shown in FIG. 10, advances upward and then moves toward the vertical slit 149 of the suction box 148, so that the warp thread 122 is guided to the vertical slit 149 by the hooked portion 159*a* of the warp holding hook 159. When this occurs, the warp thread 122 within the suction chamber 150 is held in its straight state along the suction chamber wall 150*a* with a predetermined tension, because air flows from the air passageway R to the suction chamber wall 150*a* and flows upward by the vacuum nozzles 151, 152 and 153. As shown in FIG. 13, the large part of the warp thread 122 between the warp holding hook 159 and the warp chuck 131 is then drawn in within the suction box 148, and a bridge portion is formed between the warp holding hook 159 and the warp holding bar 160 held in its horizontal position.

Figure 14:
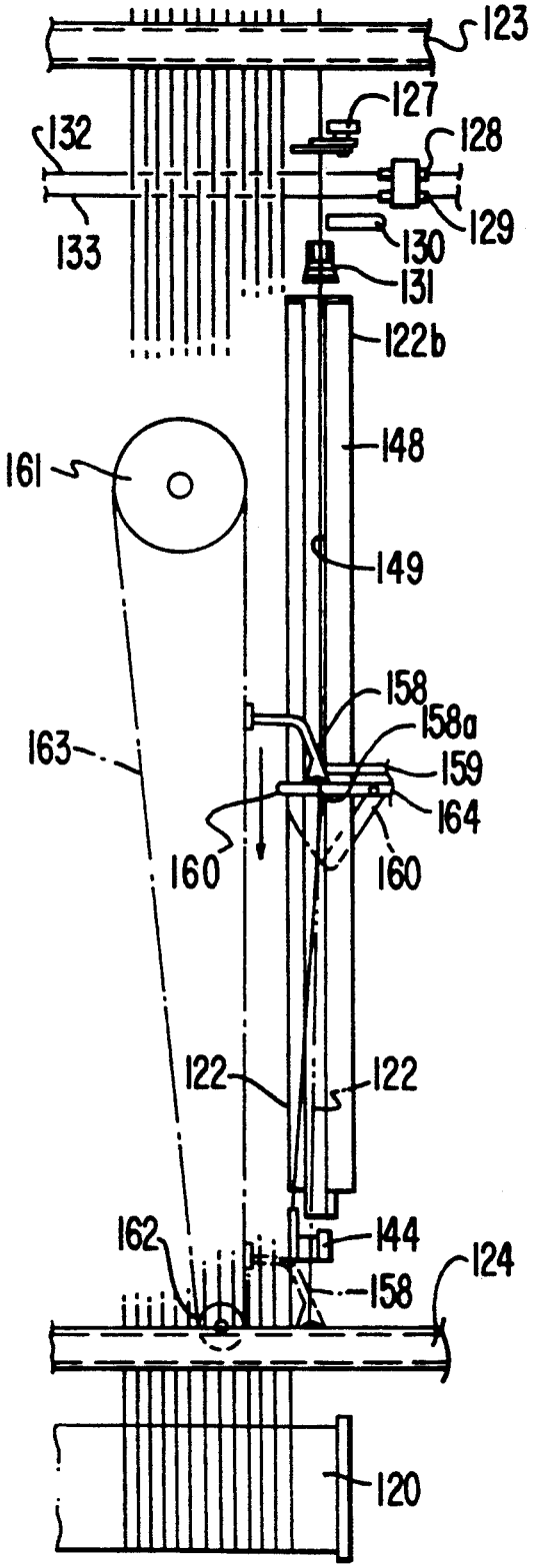
FIG. 14 is a front elevational view showing how the warp thread is lowered along the suction box through the bridge portion of the warp thread shown in FIG. 13.
Figure 15:
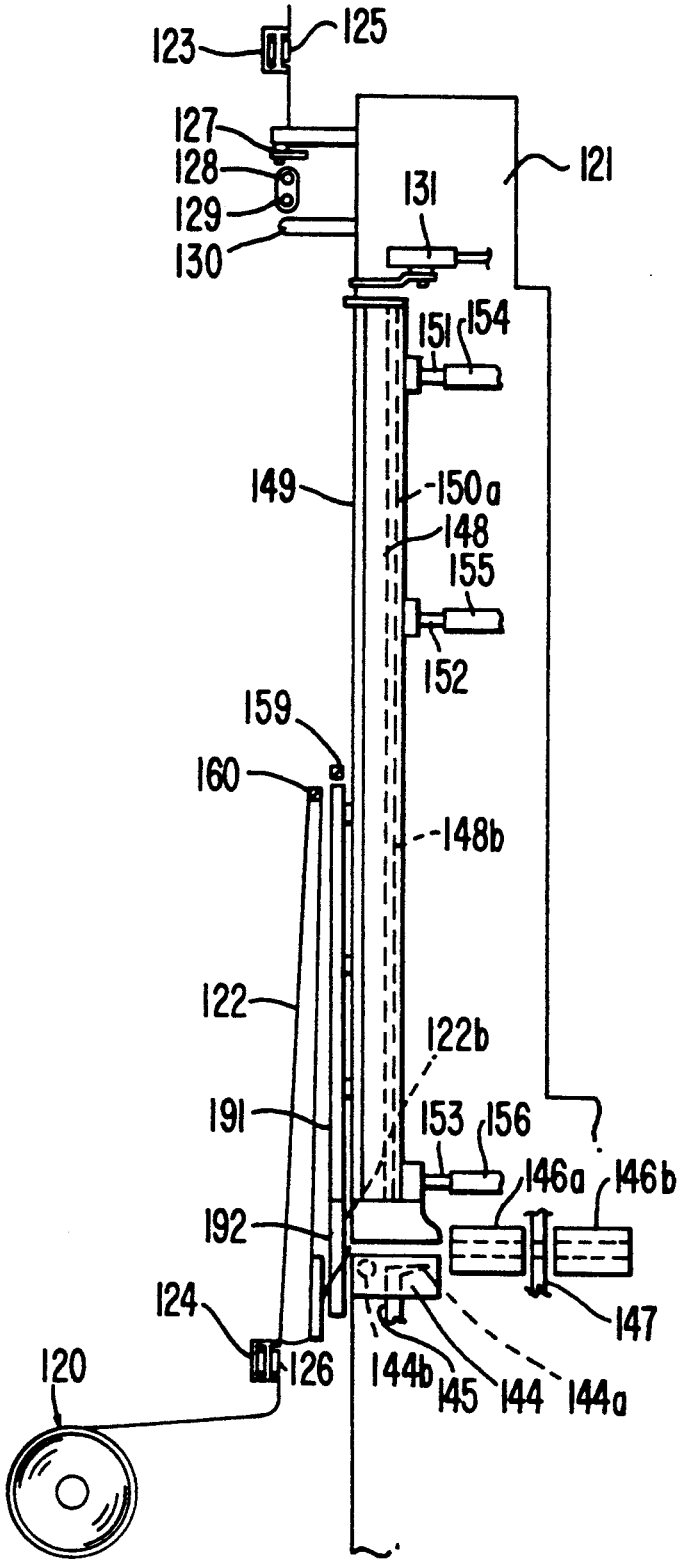
FIG. 15 is a view similar to FIG. 13 but showing the leading end portion of the warp thread lowered along the suction box.

As shown in FIG. 14, as the small pulley 162 is rotated, the warp lowering hook 158 is lowered along the vertical slit 149 of the suction box 148, so that the bridge portion between the warp holding hook 159 and the warp holding bar 160 is gripped by the grooved portion 158*a* of the warp lowering hook 158 and is lowered toward the suction nozzle 144. If, as shown in FIG. 15, the grooved portion 158*a* is lowered beyond the suction nozzle 144, the cut thread end portion 122*b* is guided by the suction nozzle 144 and the warp thread 122 is guided into the nozzle passageway 144*a* of the suction nozzle 144 by suction. At this time, as shown by the arrows a and b, the suction force produced within the suction box 148 through the vertical slit 149 is dispersed between the plates 191 and 192 and between the plates 191, 192 and the suction box 148, so that air flow to be drawn in within the suction box 148 through the space between the plates 191 and 192 and through the vertical slit 149 is weakened. Therefore, when the warp thread 122 is lowered toward the suction nozzle 144 by the warp lowering hook 158, the warp thread 122 located between the warp holding bar 160 and the vicinity of the suction nozzle 144 is prevented from being drawn in within the suction box 148. In addition, since the cut thread end portion within the suction box 148 is urged upward along the rear wall 150*a*, the thread 122 is always moved along the rear wall 150*a* during the time that the thread 122 is lowered beyond the suction nozzle 144 by the warp lowering hook 158. For this reason, the leading end portion of the warp thread 122 is guided to the inlet portion of the nozzle passageway 144*a* of the suction nozzle 144, and is drawn in within the nozzle passageway 144*a* by the compressed-air supplying portion 144*b*. The warp thread 122 is then passed through the eye 147*a* of the heddle 147 through the suction nozzle 144 and the guide nozzle 146*a*. At the same time, as shown in FIG. 14, the warp holding bar 160 is rotated downward about the pin 164 and therefore the warp thread 122 is released from the warp holding bar 160. The warp thread 122 extending from the lower horizontal beam 124 is then passed through the eye 147*a* of the heddle 147, and the threading operation is complete.

As described above, in the second embodiment of the present invention shown in FIGS. 8–15, the suction box 148 is provided with a pair of the plates 191 and 192, which are spaced a predetermined distance from the suction box 148 and extend from the warp holding bar 160 to the vicinity of the suction nozzle 144 and are spaced apart from each other across the vertical slit 149. For this reason, the suction force produced within the suction box 148 through the vertical slit 149 can be dispersed between the plates 191 and 192 and between the plates 191, 192 and the suction box 148, so that the air flow to be drawn in within the suction box 148 through the space between the plates 191 and 192 and through the vertical slit 149 can be weakened. Therefore, when the warp thread 122 is lowered toward the suction nozzle 144 by the warp lowering hook 158, the warp thread 122 located between the warp holding bar 160 and the vicinity of the suction nozzle 144 can be prevented from being drawn in within the suction box 148 and slipping off the warp holding bar 160. In addition, since the separation distance between the plates 191, 192 and the suction box 148 is longer than the width of the vertical slit 149, air to be drawn in within the suction chamber 150 through the vertical slit 149 can be obtained with certainty and weakened.

Figure 16:
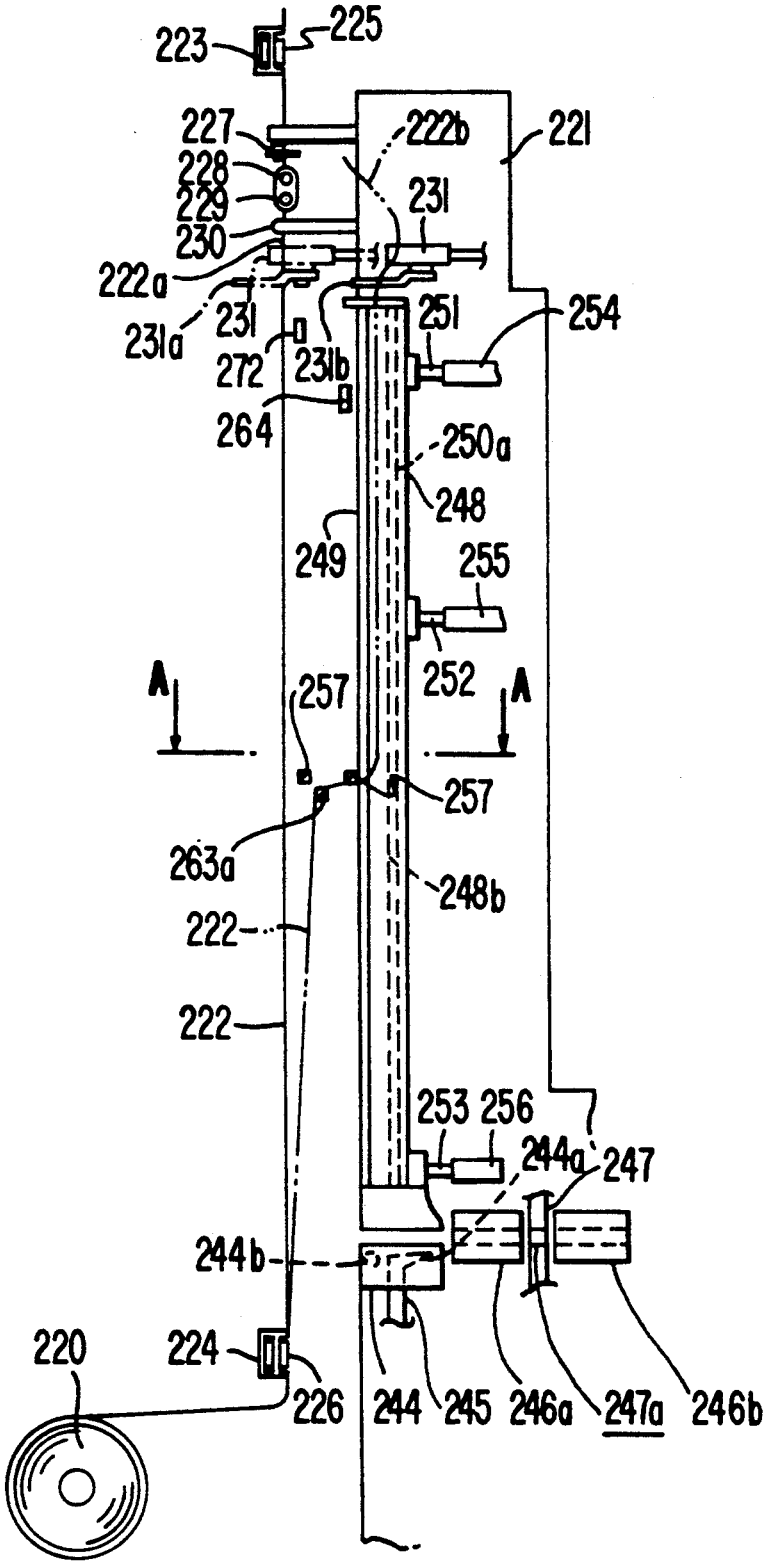
FIG. 16 is a side elevational view showing a third embodiment of the warp supplying apparatus according to the present invention.
Figure 17:
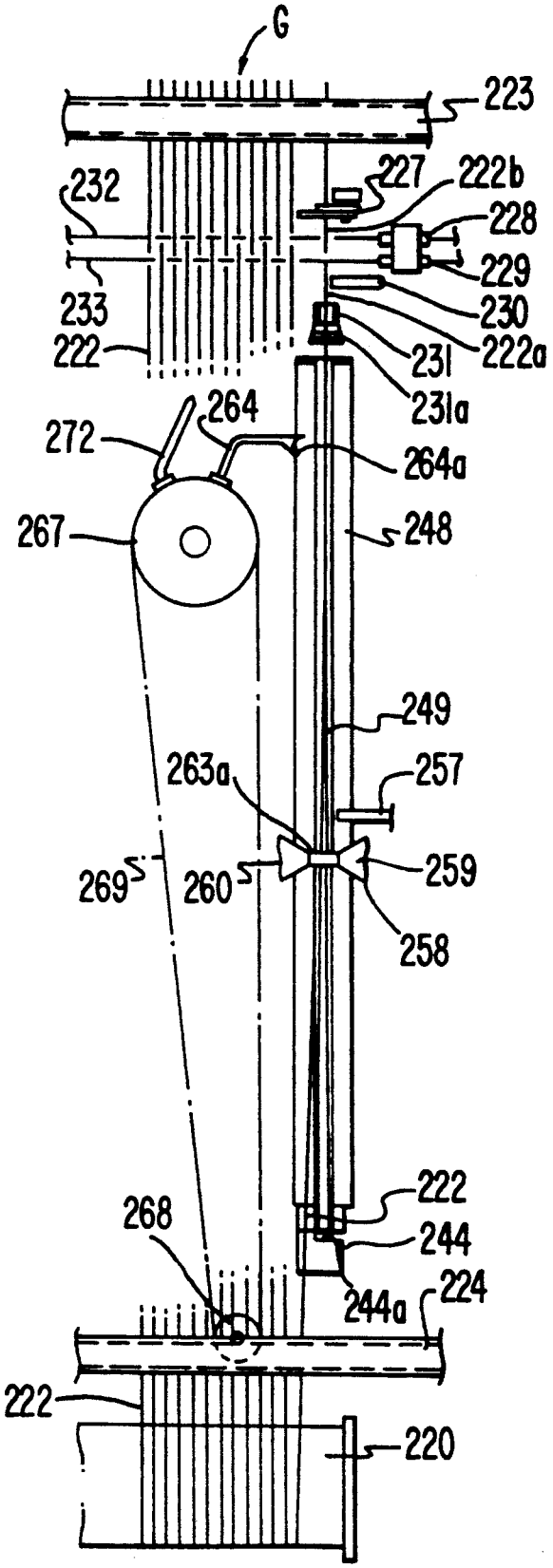
FIG. 17 is a front elevational view showing the third embodiment of FIG. 16.

FIGS. 16–25 illustrate a third embodiment of the warp supplying apparatus in accordance with the present invention. In FIGS. 16 and 17, reference numeral 220 denotes a warp beam which is supported on a back frame (not shown) disposed in the vicinity of a vertical frame 221 of a threading machine and on which a plurality of warp threads 222 are wound. The warp threads, as shown in FIG. 17, are supported by a pair of warp tightening beams 223 and 224 (parallel holding means) and arranged in parallel along the axial direction of the warp beam 220. Reference numerals 225 and 226 are gripping plates, respectively, which are inserted into grooves of the warp tightening beams 223 and 224. The gripping plates 225 and 226 grip the warp threads 222, together with the warp tightening beams 223 and 224.

The warp tightening beams 223 and 224 are moved toward and away from each other by drive means (not shown) so that the warp threads 222 can be tightened. A cutter 227 (cutting means), warp separating tubes 228, 229 through which warp separating strings 232 and 233 are passed, a separation nozzle 230, and a warp chuck 231 are provided in the upper portion of the vertical frame 221. The warp separating tubes 228, 229 and the separation nozzle 230 are adapted to separate a foremost warp thread from the warp threads 222 arranged in parallel along the axial direction of the warp beam 220.

The foremost warp thread 222 is easily separated by horizontally rotating the warp separating tubes 180°.

The separated warp thread 222 is moved to the central portion of a warp chuck 231 by the separation nozzle 230. The warp chuck 231 comprises a suction nozzle portion and a warp gripping portion 231*a*. When the warp chuck 231 is moved by drive means (not shown) to the position indicated by the dotted line of FIG. 16, the warp thread 222 is drawn in by the suction nozzle portion and gripped by the gripping portion 231*a*. The warp thread 222 gripped by the warp chuck 231 is cut at the end portion 222*a* thereof by the cutter 227 provided between the upper horizontal beam 223 and the upper warp separating tube 228. A cut end portion 222*b* of the warp thread 222 formed by the cutter 227 is released from the upper horizontal beam 223.

A suction nozzle 244 is disposed below the warp chuck 231 and provided in the vertical frame 221 and connected with a conduit 245 through which compressed air is introduced from a source of compressed air (not shown). The suction nozzle 244 is formed with a nozzle passageway 244*a* along which the compressed air is supplied. If the cut end portion 222*b* of the warp thread 222 cut by the cutter 227 is guided to the suction nozzle 244, it will be drawn in and advanced along the nozzle passageway 246*a* by the injector effect of the compressed air. After the warp thread end portion 222*b* has been passed through the suction nozzle 244 and a first guide nozzle 246*a*, it is passed through an eye 247*a* of a heddle 247 positioned the first guide nozzle 246*a* and a second guide nozzle 246*b*. Reference numeral 244*b* denotes a compressed-air supplying portion which supplies compressed air toward the nozzle passageway 244*a* so that the warp thread end portion 222*b* can be easily drawn in within the nozzle passageway 244*a*.

Figure 18:
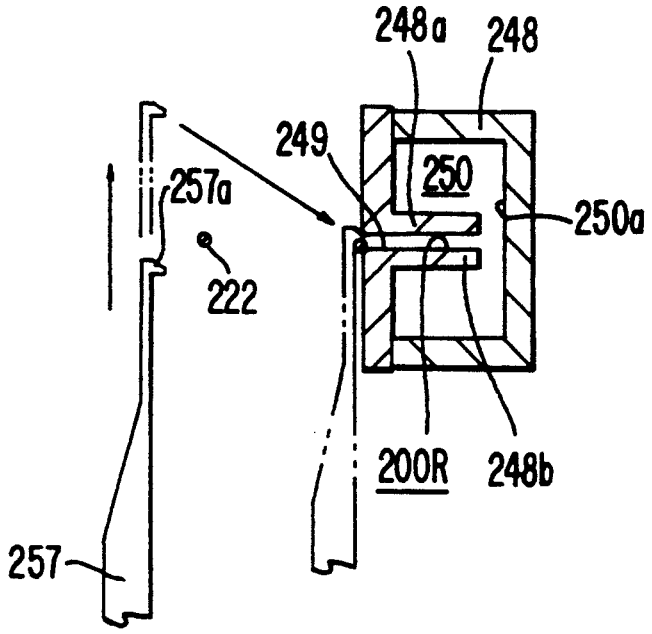
FIG. 18 is a sectional view taken substantially along line A1—A1 of FIG. 16.
Figure 29:
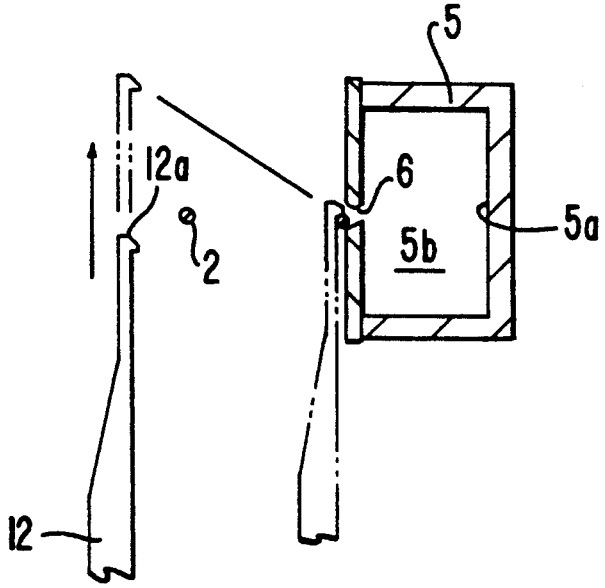
FIG. 29 PRIOR ART
FIG. 29 is a sectional view taken substantially along line A—A of FIG. 26.

A vertically extending suction box (suction and guide means) 248 with a vertical slit 249 vertically extending therethrough is provided between the warp chuck 231 and the suction nozzle 244. The vertical slit 249, as shown in FIG. 18, is open to a suction chamber 250 of the suction nozzle 244. The suction nozzle 244 is further formed with a pair of side walls 248*a* and 248*b*, which extend from the vertically extending slit 249 toward a rear wall 250*a* of the suction box 244 to form an air passageway 200R for guiding the warp thread 222 to the rear wall 250*a*.

The suction chamber 250 of the suction box 248 is connected at the upper portion thereof with a vacuum nozzle 251, at the intermediate portion with a vacuum nozzle 252 and at the lower portion with a vacuum nozzle 253. The vacuum nozzles 251, 252 and 253 are connected with a source of vacuum (not shown) through conduits 254, 255 and 256. When air is drawn in within the suction chamber 250 through the vertical slit 249 of the suction box 248, the warp thread 222 is moved to the vertical slit 249 and drawn in within the suction chamber 250 through the air passageway R. The warp thread 222 cut by the cutter 227 is guided by the suction box 248 and lowered to the suction nozzle 244. At this time, the warp thread 222 within the suction chamber 250 is held upward in a straight state with a predetermined tension along the rear wall 250*a* of the chamber 250, because the air from the air passageway R to the rear wall 250*a* flows upward by the vacuum nozzles 251, 252 and 253.

A warp holding hook 257 is provided between the warp thread 222 and the suction box 248 and in the longitudinal central portion of the suction box 248. The warp holding hook 257 has a distal portion formed with a hooked portion 257*a*, as shown in FIG. 18, and also has a proximal portion which is drive to move in the up and down directions and in the right and left directions of FIG. 18 by a drive mechanism (not shown). If the end portion 222*a* of the warp thread 222 is gripped by the warp chuck 231 and cut by the cutter 227 and the warp chuck 231 is moved back, the warp holding hook 257 is moved upward and then in the right direction so that the warp thread 222 is guided to the vertical slit 249 of the suction box 248, as shown in FIG. 18. At this time, the warp thread 222 is gripped by the hooked portion 257*a* of the warp holding hook 257, and the cut end portion 222*b* of the warp thread 222 guided to the vertical slit 249 of the suction box 248 is drawn in within the suction chamber 250 through the vertical slit 249 and the air passageway R.

Figure 19A:
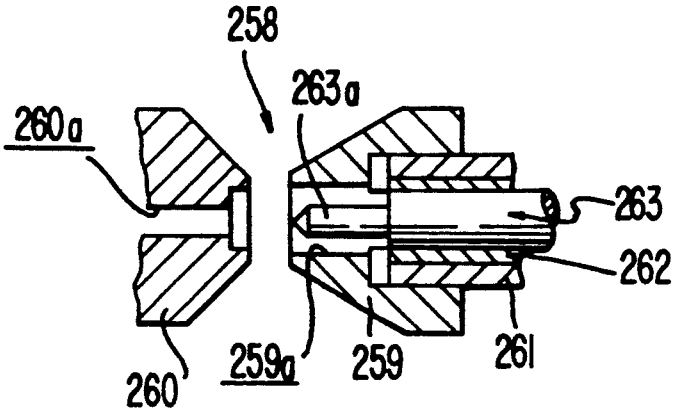
FIGS. 19(*a*), 19(*b*) and 19(*c*) are enlarged front views showing the intermediate holding means of FIG. 8, FIG. 19(*a*) showing a condition in which a heddle is threaded, FIG. 19(*b*) showing the intermediate holding means in its normal state, and FIG. 19(*c*) showing a condition in which the intermediate portion of the warp thread is fixedly held by the intermediate holding means.
Figure 19B:
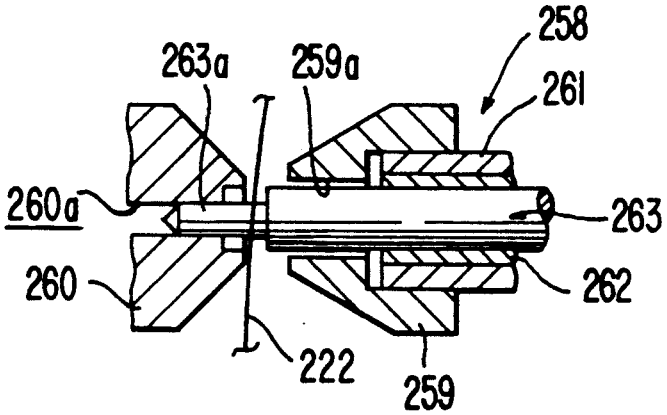
Figure 19C:
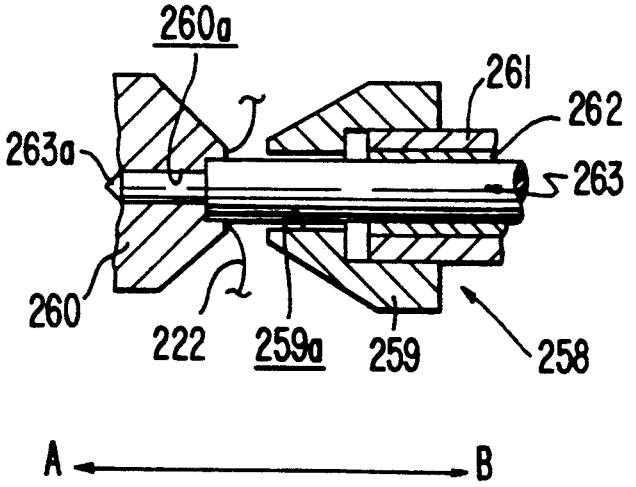

Reference numeral 258 denotes intermediate holding means, which is provided between the warp thread 222 and the suction box 248 and in the longitudinal central portion of the suction box 248. The intermediate holding means 258 holds the intermediate portion of a foremost warp thread 222 separated from among the following warp thread group G, at a position spaced a predetermined distance from the warp thread group G. The intermediate holding means 258 is freely rotatably supported on the frame 221, and as shown in FIGS. 19(*a*)–19(*c*), comprises a pair of support members 259 and 260 movable toward and away from the slit 249, an outer cylindrical member 261 provided in the inner surface of the support member 259, and a rod 263 slidably supported on an inner cylindrical member 262 mounted on the outer cylindrical member 262. The rod 263 has a small diameter portion 263*a* which is protruded from and retracted in a bore 259*a* formed in the support member 259. The rod 263 is moved in the directions A and B indicated in FIG. 19(*c*) by means of drive means (not shown). The rod 263 is normally held in the position of FIG. 19(*b*) in which the small diameter portion 263*a* thereof is inserted into a counter bore 260*a* of the support member 260. As will be described later, the rod 263 is moved in the directions A and B, when a warp lowering hook is lowered and raised. As indicated by the dotted line in FIG. 18, a bridge portion is formed between the warp holding chuck 257 and the small diameter portion 263*a* of the intermediate holding means 258, if the cut end portion 222*b* of the warp thread 22 is guided to the suction chamber 250 of the suction box 248.

Figure 20:
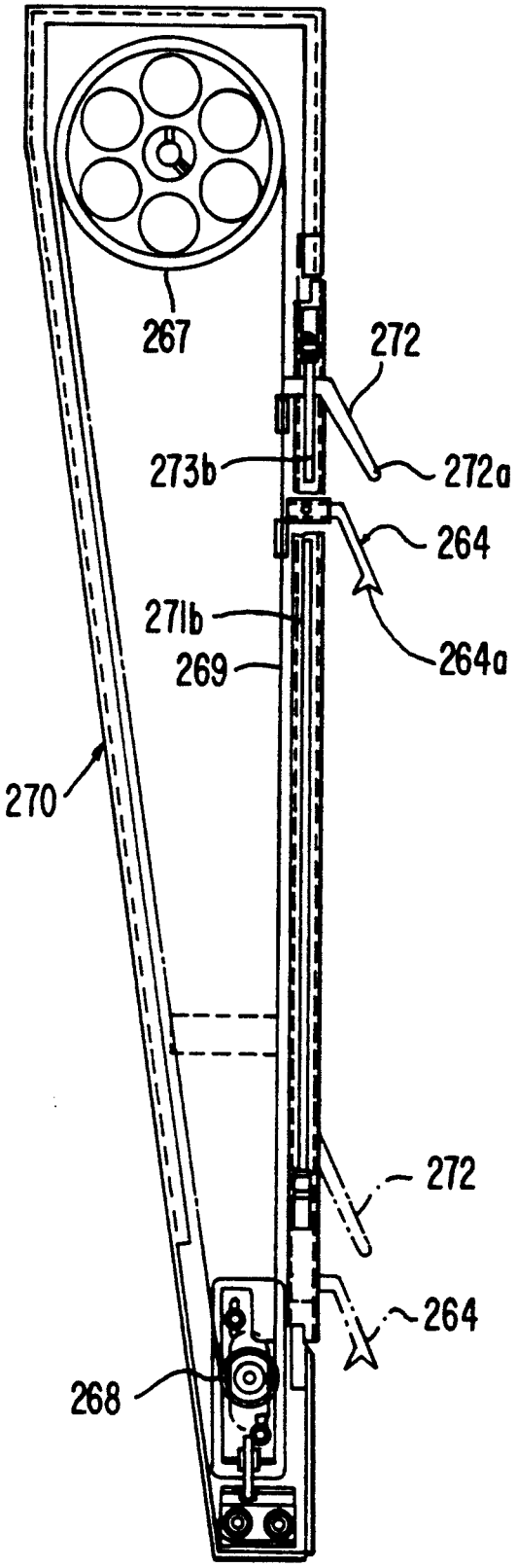
FIG. 20 is a front end view showing the larger pulley, the smaller pulley and the timing belt of FIG. 17.

Reference numeral 264 denotes a warp lowering hook (warp conveying means), which is formed into a substantially L shape and has a proximal portion fixedly mounted on a timing belt 269 which is driven by a larger pulley 267 and a smaller pulley 268. As shown in FIGS. 19 and 20, the larger pulley 267 is connected to a source of drive 266 through a drive shaft 265 freely rotatably supported in the upper portion of the vertical frame 221. The warp lowering hook 264 also has a grooved portion 264*a* at the distal portion thereof.

Figure 21:
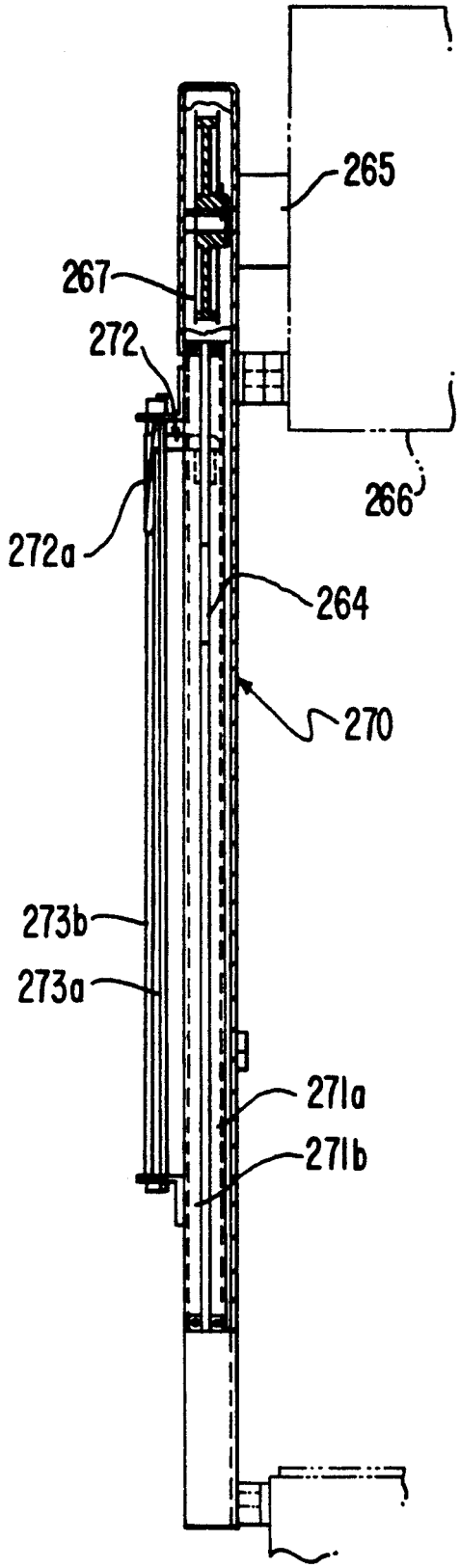
FIG. 21 is a side view showing the larger pulley, the smaller pulley and the timing belt of FIG. 20.

If the larger pulley 267 is rotated in one direction by the drive source 266, the grooved portion 264*a* of the warp lowering hook 264 is lowered along the vertical slit 249 of the suction box 248 to the vicinity of the lower horizontal beam 224. If, on the other hand, the larger pulley 267 is rotated in the other direction, the grooved portion 264*a* of the warp lowering hook 264 is raised and returns back to its original position. As shown in FIG. 21, a frame 270 enclosing the larger pulley 267 is provided with a pair of spaced guides 271*a* and 271*b* between which the warp lowering hook 264 is provided and along which the warp lowering hook 264 is guided.

A scraper (separation means) 272 is fixedly mounted on the timing belt 269. The scraper 272, as shown in FIGS. 20 and 21, has a proximal portion fixedly mounted on the timing belt 269 and is disposed above the warp lowering hook 264. The scraper 272 also has its distal portion 272*a* which is disposed away from the proximal portion of the warp lowering hook 264 in the direction opposite to the suction box 248 and which is disposed between the intermediate holding means 258 and the warp thread group G. If the larger pulley 267 is driven, the scraper 272, together with the warp lowering hook 264, will be lowered separating the foremost warp thread from the warp thread group G. The frame 270 enclosing the larger pulley 267 is also provided with a pair of spaced guides 273*a* and 273*b* between which the scraper 272 is provided and along which the scraper 272 is guided.

The operation of the warp supplying apparatus in accordance with the third embodiment of the present invention shown in FIG. 16 will hereinafter be described.

In FIGS. 16 and 17, the warp threads 222 unwound from the warp beam 220 are held between the upper and lower horizontal beams 223 and 224. If the foremost warp thread 222 is separated by rotations of the warp separating tubes 228 and 229, then the separation nozzle 230 advances to grip the end portion 222*a* of the foremost warp thread 222. The warp thread end portion 222*a* gripped by the separation nozzle 230 is moved to the central portion of the warp chuck 231, as shown in FIG. 16. The warp chuck 231 is then moved from the position indicated by the solid line in FIG. 16 to the position indicated by the dotted line in order to grip the warp thread end portion 222*a*.

Figure 22:
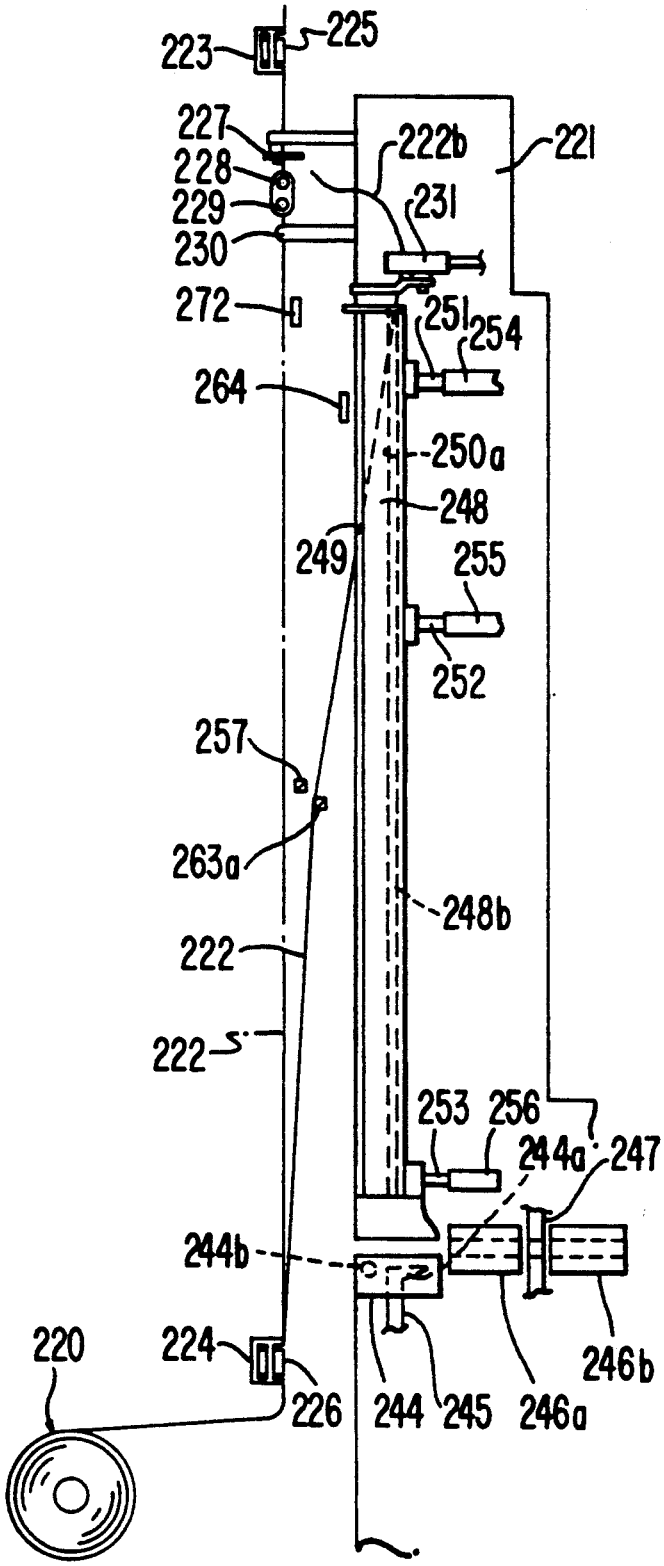
FIG. 22 is a side elevational view showing the third embodiment of FIG. 16 in which the leading end portion of the warp thread is moved toward the suction box.

If the thread end portion 222*a* gripped by the warp chuck 231 is cut by the cutter 227, then the cut end portion 222*b* gripped by the warp chuck 231 is moved toward the suction box 248 and, as shown in FIG. 22, the cut end portion 222*b* in the vicinity of the warp chuck 231 is drawn in within the vertical suction box 248 through the slit 249 and the passageway 200R. At that time, since, as shown in FIG. 19(*b*), the small diameter portion 263*a* of the rod 263 has been inserted into the bore 260*a*, the warp thread 222 is supported at its intermediate portion on the small diameter portion 263*a*. As a result, the upper half portion of the warp thread 222 between the intermediate holding means 258 and the warp chuck 231 is drawn in within the suction chamber 250 of the suction box 248, as shown in FIG. 22.

Figure 23:
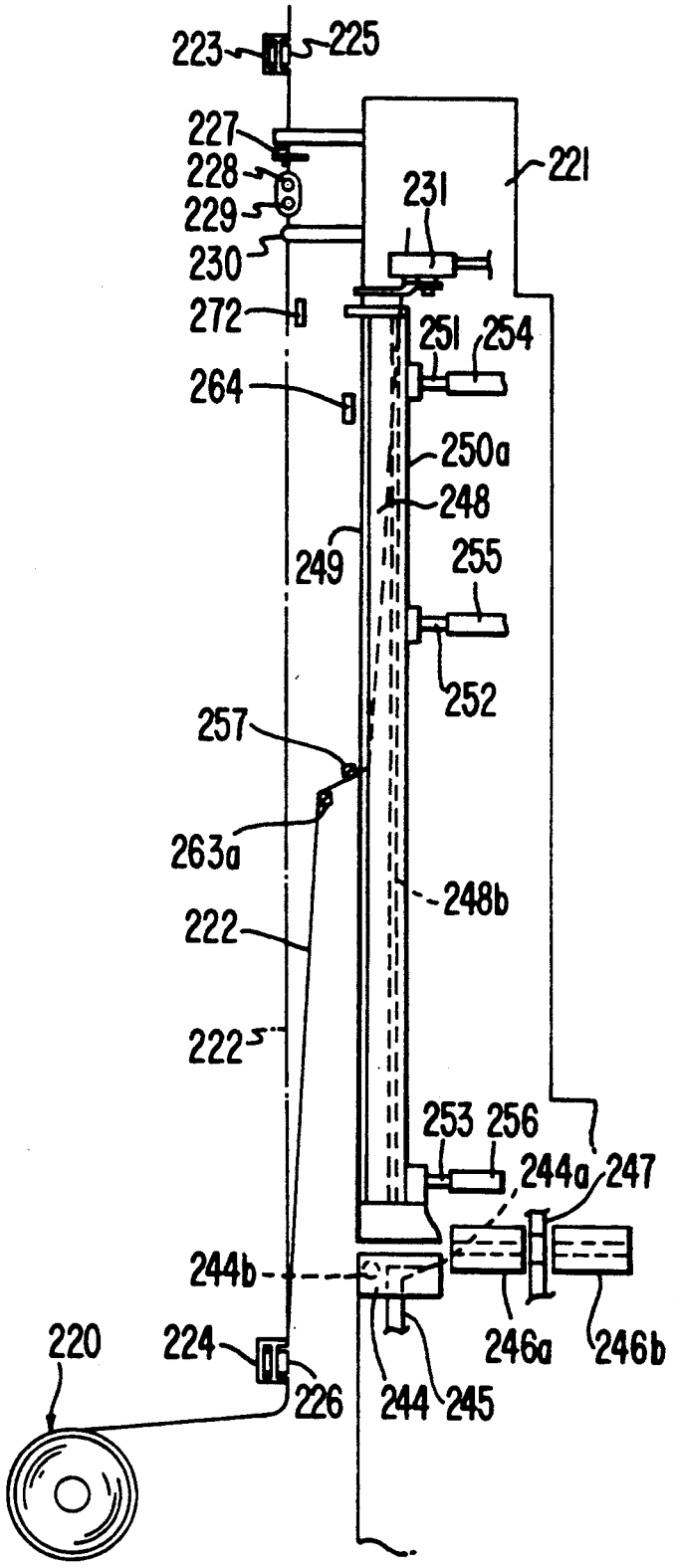
FIG. 23 is a view similar to FIG. 22 but showing the leading end portion of the warp thread drawn in within the suction box by suction and a bridge portion formed in the longitudinal central portion of the warp thread.

On the other hand, the warp holding hook 257, as shown in FIG. 18, advances upward and then moves toward the vertical slit 249 of the suction box 248, so that the warp thread 222 is guided to the vertical slit 249 by the hooked portion 257*a* of the warp holding hook 257. When this occurs, the warp thread 222 within the suction chamber 250 is held in its straight state along the suction chamber wall 250*a* with a predetermined tension, because air flows from the air passageway R to the suction chamber wall 250*a* and flows upward by the vacuum nozzles 251, 252 and 253. As shown in FIG. 23, the large part of the warp thread 222 between the warp holding hook 257 and the warp chuck 231 is then drawn in within the suction box 248, and a bridge portion is formed between the warp holding hook 257 and the intermediate holding means 258 held in its horizontal position.

Figure 24:
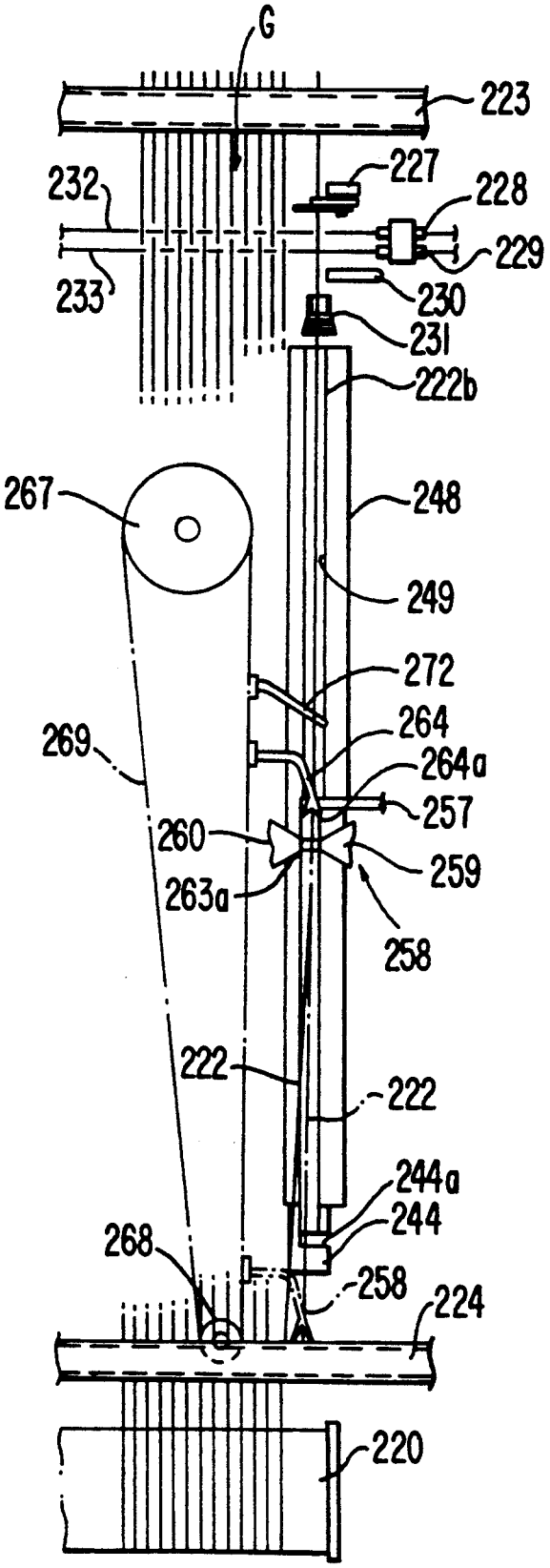
FIG. 24 is a front elevational view showing how the warp thread is lowered along the suction box through the bridge portion of the warp thread shown in FIG. 23.
Figure 25:
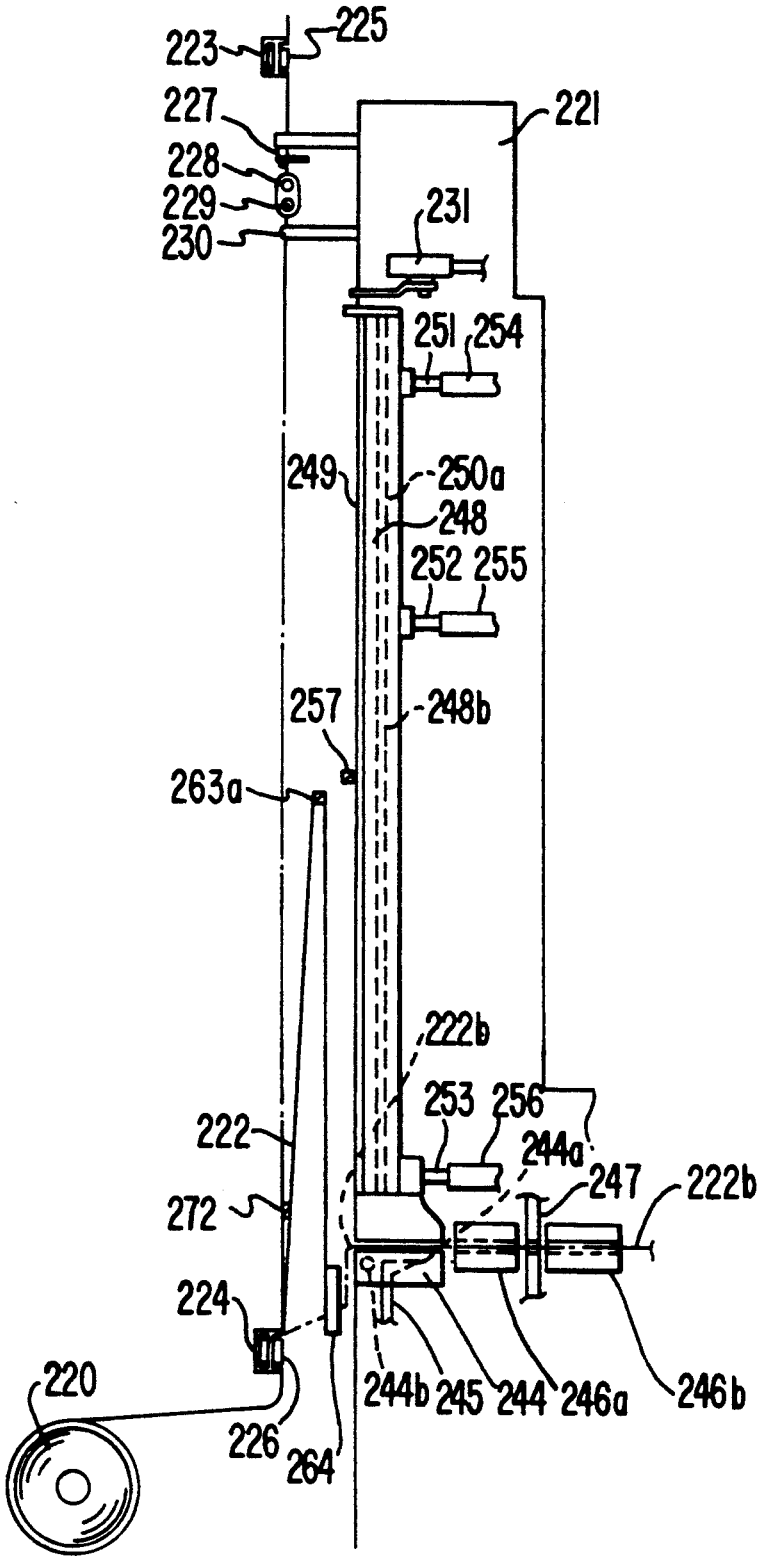
FIG. 25 is a view similar to FIG. 23 but showing the leading end portion of the warp thread lowered along the suction box.
Figure 26:
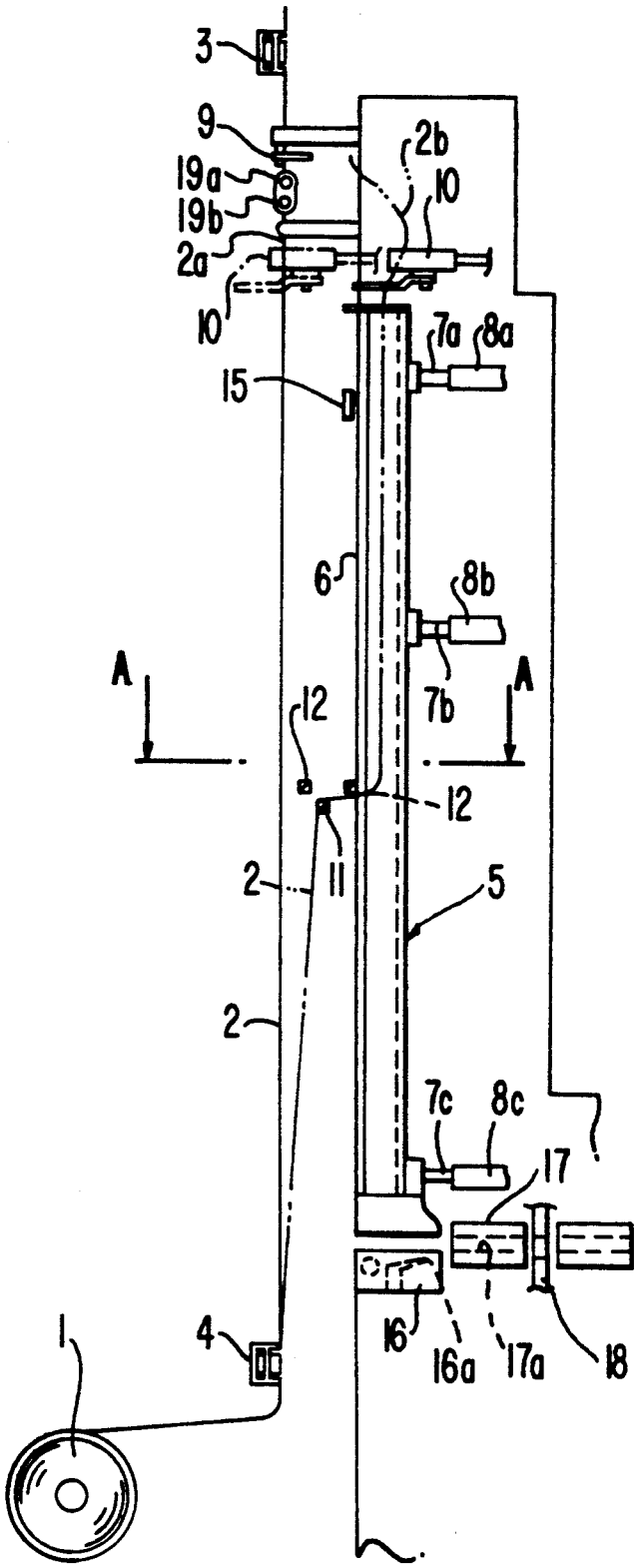
FIG. 26 PRIOR ART
FIG. 26 is a side elevational view showing a conventional warp supplying apparatus.
Figure 27:
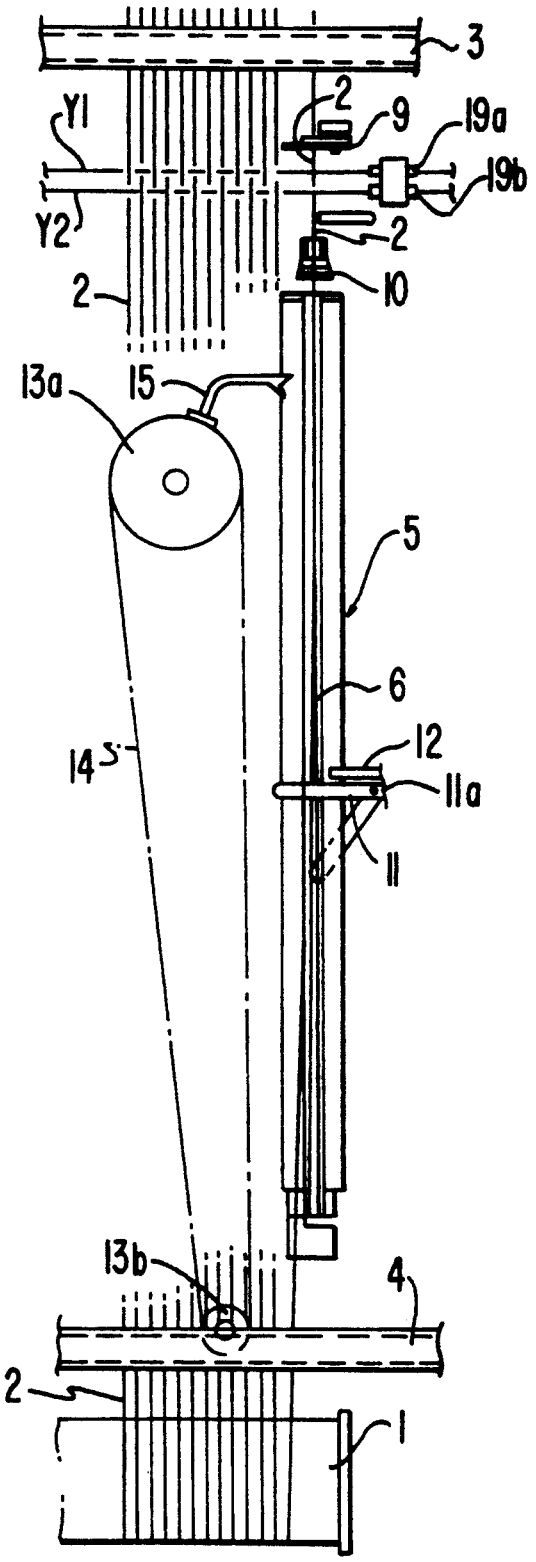
FIG. 27 PRIOR ART
FIG. 27 is a front view showing the conventional warp supplying apparatus.
Figure 28:
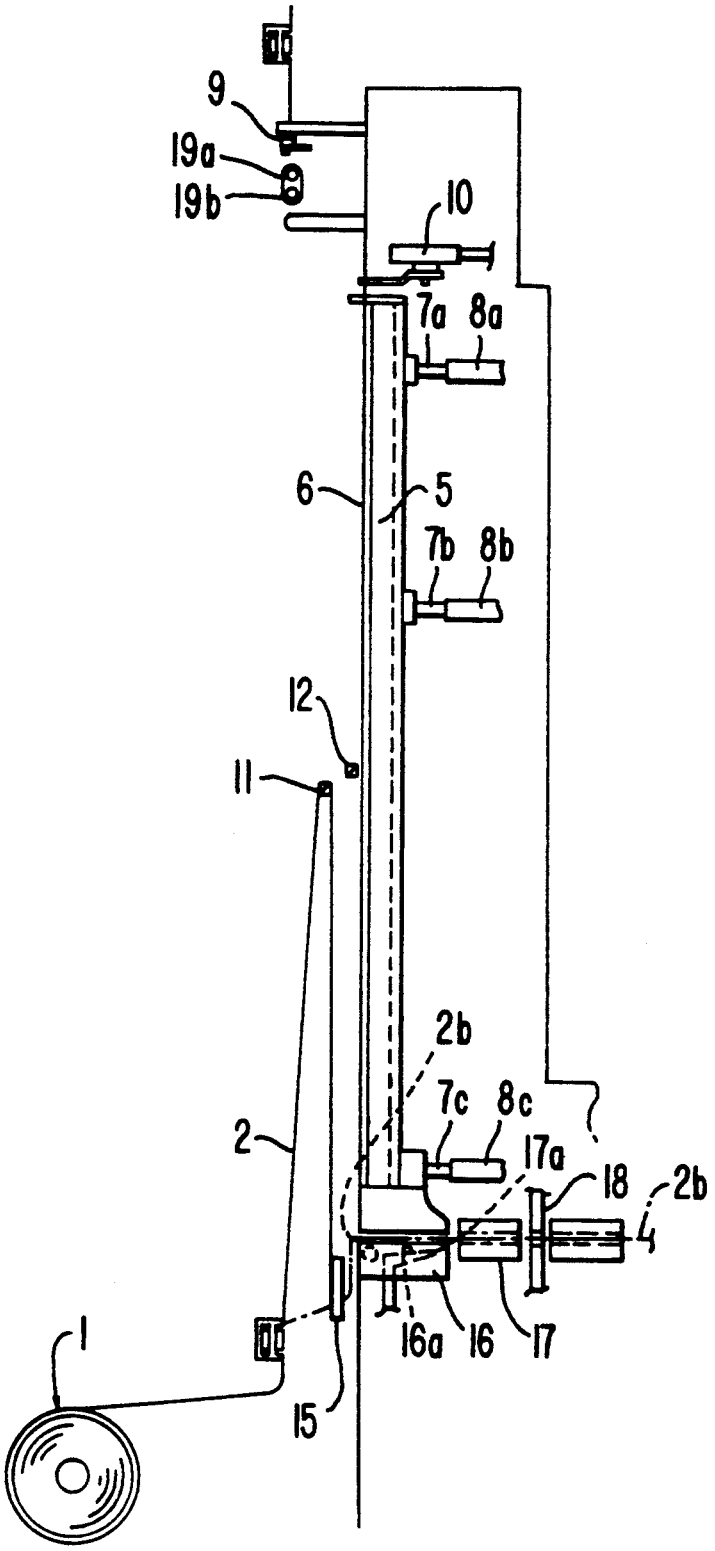
FIG. 28 PRIOR ART
FIG. 28 is a side elevational view showing how a warp is supplied to a threading machine by the conventional warp supplying apparatus.

As shown in FIG. 24, as the larger pulley 267 is rotated, the warp lowering hook 264 is lowered along the vertical slit 249 of the suction box 248, so that the bridge portion between the warp holding hook 257 and the intermediate holding bar 258 is gripped by the grooved portion 264*a* of the warp lowering hook 264 and is lowered toward the suction nozzle 244. At this time, as shown in FIG. 19(*c*), the small diameter portion 263*a* is completely inserted into the bore 260*a* of the projection member 260 and therefore the intermediate portion of the warp thread 22 is fixedly held by the intermediate holding means 258. Thereafter, if the warp lowering hook 264 is further lowered, the scraper 272 is also lowered toward the suction nozzle 244 and interposed between the foremost warp thread 222 and the warp thread group G so that the foremost warp thread 222 is separated from the warp thread group G.

If, as shown in FIG. 24, the grooved portion 264*a* of the warp lowering hook 264 is lowered beyond the suction nozzle 244, the cut thread end portion 222*b* is guided by the suction nozzle 244 and the warp thread 222 is guided into the nozzle passageway 244*a* of the suction nozzle 244 by suction. The warp thread 222 is then passed through the eye 247*a* of the heddle 247 through the suction nozzle 244 and the guide nozzle 246*a*. At the same time, as shown in FIG. 19(*a*), the small diameter portion 263*a* of the intermediate holding means 258 is retracted into the bore 259*a* and the warp thread between the intermediate holding means 258 and the lower beam 224 is released from the intermediate holding means. The released warp thread is then passed through the eye 247*a* of the heddle 247, and the threading operation is complete.

As described above, in the third embodiment of the present invention of FIG. 16, the scraper 272 is provided so that a foremost warp thread can be separated from among a plurality of warp threads arranged in parallel, and the intermediate holding means 258 is provided so that the intermediate portion of the warp thread can be fixedly held. For this reason, the warp thread can be separated easily and certainly and supplied to the suction nozzle 244*a* easily and certainly. As a result, a threading machine can be operated at high speeds.

While the subjection invention has been described with relation to the preferred embodiments, various modifications and adaptations thereof will now be apparent to those skilled in the art. All such modifications and adaptations as fall within the scope of the appended claims are intended to be covered thereby.

What we claim is:

1. A warp supplying apparatus comprising:

warp gripping means for gripping a leading end portion of a warp thread supported by upper and lower horizontal beams;

cutting means for cutting said leading end portion of said warp thread gripped by said warp gripping means, the cutting means being positioned above said warp gripping means;

a suction nozzle positioned below said warp gripping means to draw in a cut end portion of said warp thread cut by said cutting means;

a suction box positioned between said warp gripping means and said suction nozzle for drawing in and guiding said cut end portion of said warp thread to said suction nozzle, the suction box defining a suction chamber and a slit through which said cut end portion of said warp thread is drawn in within said suction chamber by suction; and warp conveying means for conveying said cut end portion of said warp thread within said suction chamber from said warp gripping means to said suction nozzle;

said suction box having a rear wall opposed to said slit and a pair of spaced walls positioned inside said suction box and extending from said slit toward said rear wall to form a guide passageway for guiding said cut end portion of said warp thread to said rear wall of said suction box.

2. A warp supplying apparatus comprising:

warp gripping means for gripping a leading end portion of a warp thread supported by upper and lower horizontal beams;

cutting means for cutting said leading end portion of said warp thread gripped by said warp gripping means, the cutting means being positioned above said warp gripping means;

a suction nozzle positioned below said warp gripping means to draw in a cut end portion of said warp thread cut by said cutting means;

a suction box positioned between said warp gripping means and said suction nozzle for drawing in and guiding said cut end portion of said warp thread to said suction nozzle, the suction box defining a suction chamber and a slit through which said cut end portion of said warp thread is drawn in within said suction chamber by suction, said slit having a long dimension;

warp conveying means for conveying said cut end portion of said warp thread within said suction chamber from said warp gripping means to said suction nozzle;

warp holding means provided in the vicinity of said warp conveying means for engaging said warp thread conveyed to said suction nozzle by said warp conveying means and holding said warp thread at a predetermined position; and a pair of plates mounted on said suction box so that they are spaced a predetermined distance from the suction box and extend along the long dimension of said slit from said warp holding means to the vicinity of said suction nozzle and are spaced from each other across said slit.

3. A warp supplying apparatus as set forth in claim 2, wherein said predetermined distance between said plates and said suction box is longer than a width of said slit of said suction box.

4. A warp supplying apparatus comprising:

a plurality of warp threads wound on a warp beam;

first holding means to hold said plurality of warp threads so that said warp threads are arranged in parallel along an axial direction of said warp beam;

cutting means for cutting a leading end portion of a foremost warp thread of said plurality of warp threads arranged in parallel by said first holding means;

suction and guide means for drawing in a cut end portion of said foremost warp thread cut by said cutting means and for guiding said cut end portion to a first position spaced a first predetermined distance from said plurality of warp threads;

intermediate holding means provided between said plurality of warp threads and said suction and guide means for holding an intermediate portion of said foremost warp thread in a second position spaced a second predetermined distance from said plurality of warp threads;

warp conveying means that engages with a portion of said foremost warp thread between said intermediate holding means and said suction and guide means and conveys said cut end portion of said foremost warp thread drawn in within said suction and guide means in a direction opposite to the drawing-in direction of said suction and guide means, said cut end portion of said foremost thread being supplied to a third position by moving said warp conveying means in the opposite direction with respect to said intermediate holding means; and a separation member provided between said plurality of warp threads and said intermediate holding means for separating said foremost warp thread from said plurality of warp threads by moving in a direction in which said warp conveying means moves;

said intermediate portion of said foremost warp thread being fixedly held by said intermediate holding means, when said separation member is moved in said opposite direction.

* * * * *